US011319111B2

(12) United States Patent
Zeanah

(10) Patent No.: US 11,319,111 B2
(45) Date of Patent: May 3, 2022

(54) MULTI-PIECE NESTABLE BASKET SET AND METHODS

(71) Applicant: American Accessories International LLC, Knoxville, TN (US)

(72) Inventor: David Zeanah, Knoxville, TN (US)

(73) Assignee: AMERICAN ACCESSORIES INTERNATIONAL LLC, Knoxville, TN (US)

( * ) Notice: Subject to any disclaimer, the term of this patent is extended or adjusted under 35 U.S.C. 154(b) by 210 days.

(21) Appl. No.: 16/678,481

(22) Filed: Nov. 8, 2019

(65) Prior Publication Data

US 2020/0148418 A1 May 14, 2020

Related U.S. Application Data

(60) Provisional application No. 62/757,436, filed on Nov. 8, 2018.

(51) Int. Cl.
*B65D 21/02* (2006.01)
*B65D 25/28* (2006.01)

(52) U.S. Cl.
CPC ..... *B65D 21/0233* (2013.01); *B65D 25/2823* (2013.01)

(58) Field of Classification Search
CPC ..... B65D 21/0233; B65D 25/2823; B65D 21/0235; B65D 21/0209
USPC ..... 206/503, 499, 509, 510, 502, 505, 506, 206/515, 557; 220/4.26, 475, 23.6
See application file for complete search history.

(56) References Cited

U.S. PATENT DOCUMENTS 3,223,280 A * 12/1965 Kazimier ..... B65D 71/0003 206/203
4,040,517 A * 8/1977 Torokvei ..... B65D 1/243 206/144

* cited by examiner

*Primary Examiner* — Rafael A Ortiz
(74) *Attorney, Agent, or Firm* — Troutman Pepper Hamilton Sanders LLP; Ryan A. Schneider; Christopher C. Close, Jr.

(57) ABSTRACT

Multi-piece nestable basket sets are disclosed. In some embodiments, the basket sets comprise a handle component and a basket component. The present disclosure describes a system of shipping the components separately and assembling the components into a basket set prior to retail sale to customers. Exemplary basket components are configured to allow a first basket component to nest within a second basket component. In some embodiments, the basket sets herein can provide a centrally-located handle so that the set may be carried with one hand. A connecting mechanism is described wherein a handle component is connected to a basket component to create an integrated basket set that resists disassembly. Multiple embodiments of connecting mechanisms are described. One exemplary connecting mechanism comprises a handle component having two flanges that snap onto the base of a basket.

10 Claims, 16 Drawing Sheets

MULTI-PIECE NESTABLE BASKET SET AND METHODS

CROSS-REFERENCE TO RELATED APPLICATIONS

This application claims the benefit of U.S. Provisional Application Ser. No. 62/757,436, filed on 8 Nov. 2018, which is incorporated herein by reference in its entirety as if fully set forth below.

TECHNICAL FIELD

Embodiments of the present disclosure relate generally to multi-piece nestable basket sets, and, more particularly, to multi-piece nestable basket sets configured to nest for shipment and be assembled prior to sale.

BACKGROUND

Parenting in today's economy may be different in some aspect than the parenting in generations past, but one thing remains constant throughout the ages: parents want the best for their children. Many times, providing the best means selecting the best consumer care products for a child. Luckily, in today's competitive market, parents have a tremendous number of products to choose from. One area for parental choice is in child and infant bath and shower products. Whether it be choosing a night-time bath product or finding an extra-gentle product for their child, parents today can find the products that meet their needs.

In addition to the great number of bath and shower product choices in the market, ancillary products designed to assist parents with bath time are also numerous. One such product is the bath basket, which is made to contain and transport the bath products. Regularly, bath baskets are also employed to display bath products at the retail level, wherein the products and the basket are sold as a set. These sets are wonderful for parents as they provide both the products and the carrying tool to assist with their child's bath. Because they are so useful to parents, many types of bath baskets are found at retailers worldwide.

The abundancy of bath baskets creates a very real logistical problem for manufacturers: shipping costs. Shipping costs are directly related to the volume of the packaged products. To reduce the volume required to ship the baskets, many manufacturers create baskets that can nest within each other—thereby reducing wasted space around the baskets. The issue with these baskets is that handles used for transporting the basket are along the sides of the basket. What this means for a parent is that two hands are needed to carry the basket. The parent can either carry the basket or the child, but not both.

Other baskets provide a central handle so that a parent can carry the bath goods with one arm and carry their child with the other arm. With current baskets designs, however, this construction prevents the baskets from nesting; the handle in the center thereby increases the shipping volume, and cost, of the baskets.

Therefore, although parents are presented with numerous choices for their daily bath-time routines, their choices are limited by the manufacturers' shipping requirements. What is needed, therefore, is a basket that considers the parents' desire to transport bath goods with one hand, yet also considers the manufacturers' desire to have a basket that nests neatly to reduce shipping costs.

SUMMARY

Aspects of the present disclosure address these concerns as well as other needs that will become apparent upon reading the description below in conjunction with the drawings. Briefly described, embodiments of the present disclosure relate generally to multi-piece nestable basket sets. Embodiments of the present disclosure can include a handle component and a basket component. In some embodiments, the handle component and the basket component are manufactured separately. The handle component and basket component can, therefore, be shipped separately.

In some embodiments, the handle component and the basket component comprise a connecting mechanism that allows the components to be connected after shipment. In some embodiments described herein, the connecting mechanism is found on the bottom portion of the handle and within the base of the basket. In some embodiments, the bottom portion of the handle comprises two flanges, wherein the flanges are configured to snap onto the base of a basket at a connecting hole in the base. Additional embodiments of a connection mechanism are descried in greater detail. In some embodiments, the connecting mechanisms described herein are configured to lock the handle and basket components in a manner that resists disassembly. As will be appreciated after reading this disclosure, a connecting mechanism that resists disassembly is beneficial when safety is of concern.

In some embodiments of the present disclosure, space-saving systems and methods are described. In some embodiments, basket components are configured to nest within other basket components. For example, in some embodiments of the present disclosure, baskets sets are described wherein a first basket is inserted into the opening of a second basket, thereby nesting the multiple basket components together. The nesting capabilities described herein are a substantial improvement for basket sets, because consumers can receive a basket set with a central handle, and manufacturers save space because the central handle is not present in the basket set as shipped; rather, the central handle can be connected to the basket upon receipt by the retailer or consumer.

An embodiment provides a nestable basket set comprising a basket and a handle. The basket can comprise a wall defining a perimeter of the basket, a base, an upper rim proximate an upper side of the wall, a lower rim proximate a lower side of the wall, and at least one drain hole in the base. The handle can be detachable to the basket. When the handle is attached to the basket, the handle can extend to a position above the basket proximate an axis of the basket. The upper rim can define an upper rim perimeter and the lower rim can define a lower rim perimeter. The upper rim perimeter can be greater than the lower rim perimeter, which can allow nesting of baskets from multiple basket sets.

In any of the embodiments disclosed herein, the handle can comprise a first end and a second end. When the handle is attached to the basket, the first end of the handle can extend to the position above the basket proximate the axis of the basket. When the handle is attached to the basket, the second end can be attached to the base.

In any of the embodiments disclosed herein, the base can comprise a connection hole.

In any of the embodiments disclosed herein, the second end of the handle can comprise an upper flange having an upper flange perimeter, a lower flange having a lower flange perimeter greater than the upper flange perimeter, and a groove positioned between the upper flange and lower flange. When the handle is attached to the basket, the second end of the handle can extend through the connection hole such that the lower flange is proximate a lower side of the base, the upper flange is proximate an upper side of the base, and a portion of the base extends into the groove.

In any of the embodiments disclosed herein, the upper flange of the handle can comprise an angled edge, such that an upper edge of the upper flange has an upper edge perimeter and a lower edge of the upper flange has a lower edge perimeter greater than the upper edge perimeter.

In any of the embodiments disclosed herein, the first end of the handle can comprise a holding surface.

In any of the embodiments disclosed herein, the holding surface can define a loop.

In any of the embodiments disclosed herein, the nestable basket can further comprise at least one decorative drain hole positioned in the wall. The at least one decorative drain hole can have a shape substantially identical to a shape defined by the loop of the handle.

In any of the embodiments disclosed herein, the holding surface can comprise a groove.

In any of the embodiments disclosed herein, the lower rim can be non-planar with the base, such that when the basket rests on a planar surface, a gap is present between the base and the planar surface. A width of the gap can be greater than or equal to a width of a lower flange of the handle.

In any of the embodiments disclosed herein, the base can comprise a raised offset. The raised offset can create a gap between the raised offset and a planar surface when the basket rests on the planar surface. A width of the gap can be greater than or equal to a width of a lower flange of the handle.

Another embodiment provides a nestable basket storage system comprising a first nestable basket set, and a second nestable basket set. The basket of the first nestable basket set can be nested in the basket of the second nestable basket set.

Another embodiment provides a method of transporting nestable baskets, comprising: providing a first nestable basket; providing a second nestable basket set; and nesting the basket of the first nestable basket set into the basket of the second nestable basket set to create a nested basket system.

In any of the embodiments disclosed herein, the method can further comprise transporting the nested basket system to a destination.

In any of the embodiments disclosed herein, the method can further comprise: un-nesting the basket of the first nestable basket set from the basket of the second nestable basket set; and attaching the handle of the first nestable basket set to the basket of the first nestable basket set.

In any of the embodiments disclosed herein, the method can further comprise attaching the handle of the second nestable basket set to the basket of the second nestable basket set.

In any of the embodiments disclosed herein, attaching the handle of the first nestable basket set to the basket of the first nestable basket set can comprise inserting a first end of the handle of the first nestable basket set through a connection hole in the base of the basket of the first nestable basket set.

In any of the embodiments disclosed herein, attaching the handle of the first nestable basket set to the basket of the first nestable basket set can further comprise snapping an edge of the connection hole of the base of the first nestable basket between an upper and lower flange of the handle of the first nestable basket set.

In any of the embodiments disclosed herein, attaching the handle of the second nestable basket set to the basket of the second nestable basket set can comprise: inserting a first end of the handle of the second nestable basket set through a connection hole in the base of the basket of the second nestable basket set; and snapping an edge of the connection hole of the base of the second nestable basket between an upper and lower flange of the handle of the second nestable basket set.

These and other aspects of the present disclosure are described in the Detailed Description below and the accompanying figures. Other aspects and features of embodiments of the present disclosure will become apparent to those of ordinary skill in the art upon reviewing the following description of specific, example embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the disclosure discussed herein. In similar fashion, while example embodiments may be discussed below as device, system, or method embodiments, it is to be understood that such example embodiments can be implemented in various devices, systems, and methods of the present disclosure.

BRIEF DESCRIPTION OF THE FIGURES

The accompanying drawings, which are incorporated in and constitute a part of this specification, illustrate multiple embodiments of the presently disclosed subject matter and serve to explain the principles of the presently disclosed subject matter. The drawings are not intended to limit the scope of the presently disclosed subject matter in any manner.

DETAILED DESCRIPTION

Figure 1:
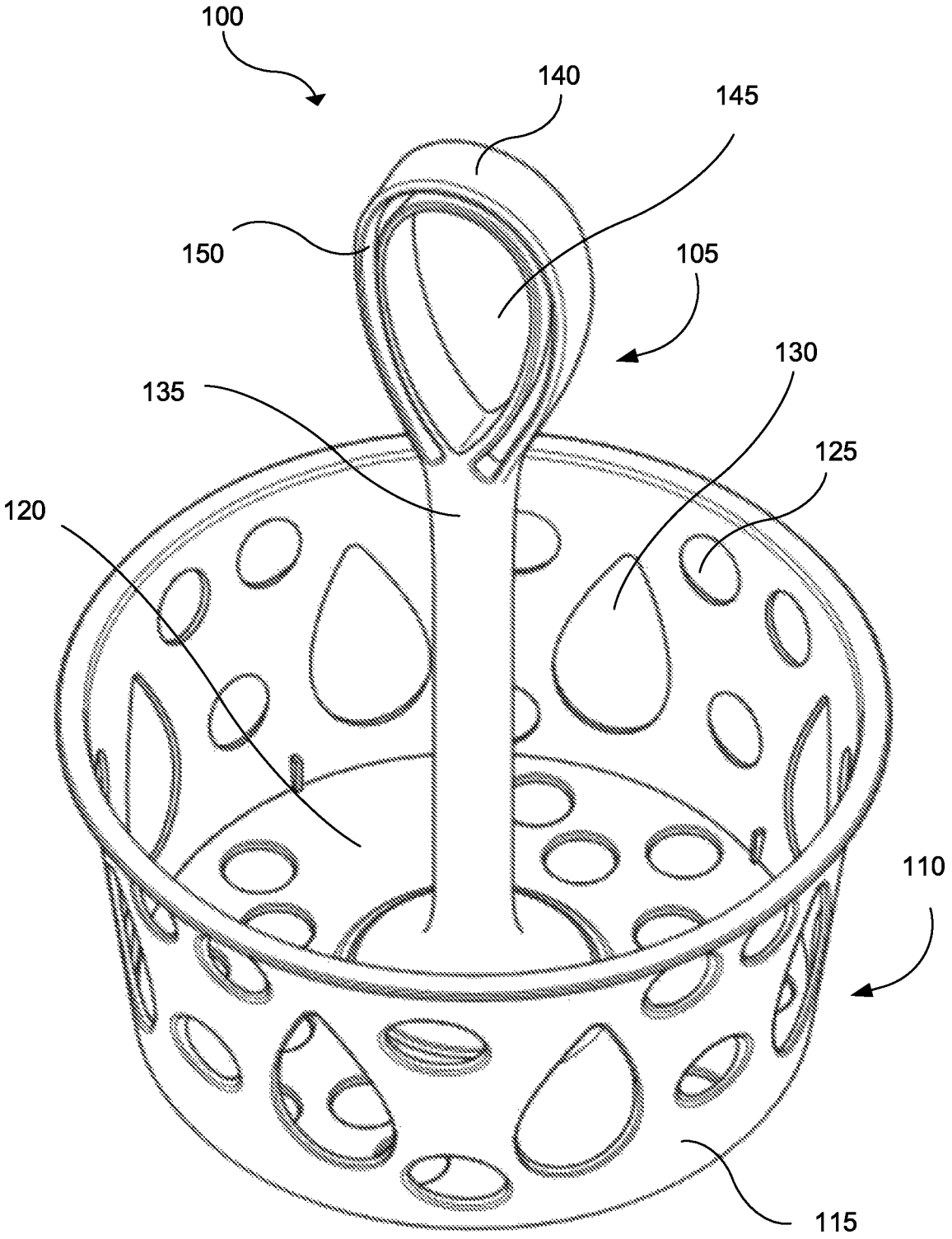
FIG. 1 is a top perspective view of an assembled basket set having a handle and basket component, in accordance with some embodiments of the present disclosure.

Although certain embodiments of the disclosure are explained in detail, it is to be understood that other embodiments are contemplated. Accordingly, it is not intended that the disclosure is limited in its scope to the details of construction and arrangement of components set forth in the following description or illustrated in the drawings. Other embodiments of the disclosure are capable of being practiced or carried out in various ways. Also, in describing the embodiments, specific terminology will be resorted to for the sake of clarity. It is intended that each term contemplates its broadest meaning as understood by those skilled in the art and includes all technical equivalents which operate in a similar manner to accomplish a similar purpose.

It should also be noted that, as used in the specification and the appended claims, the singular forms "a," "an" and "the" include plural references unless the context clearly dictates otherwise. References to a composition containing "a" constituent is intended to include other constituents in addition to the one named.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order among or between various steps herein disclosed unless and except when the order of individual steps is explicitly required.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter. Additionally, the components described herein may apply to any other component within the disclosure. Merely discussing a feature or component in relation to one embodiment does not preclude the feature or component from being used or associated with another embodiment.

To facilitate an understanding of the principles and features of the disclosure, various illustrative embodiments are explained below. In particular, the presently disclosed subject matter is described in the context of being multi-piece nestable basket sets configured to nest for shipment and be assembled prior to sale. The present disclosure, however, is not so limited and can be applicable in other contexts. For example and not limitation, some embodiments of the present disclosure may improve other carrying systems that may benefit from nesting capabilities during shipment. Additionally, embodiments of the present disclosure may improve transport of many items, including, for example and not limitation, bath products, toys, bottles, or any other consumer good. These embodiments are contemplated within the scope of the present disclosure. Accordingly, when the present disclosure is described in the context of multi-piece nestable basket sets configured to nest for shipment and be assembled prior to sale, it will be understood that other embodiments can take the place of those referred to.

In some embodiments, the present disclosure discusses multi-piece nestable basket sets configured to nest for shipment and be assembled prior to sale. For example, a basket set may comprise a handle component and a basket component, each shipped separately and later assembled, wherein the baskets components can nest. A basket set as described herein may comprise more than two components that must be assembled prior to sale. In the present disclosure, when a basket set is referred to as being assembled "prior to sale," this means that the basket set is assembled from its multiple components prior to retail. Many basket sets described herein are not sold directly to consumers in their individual two or more components; in some embodiments, the basket sets are configured to prevent a consumer from disassembling the set. It is also conceived, however, that the system and methods presented in this disclosure may be valuable in consumer-facing contexts. As such, it is also conceived that a multi-piece nestable basket may also be supplied as separate components to consumers.

In some embodiments, a multi-piece basket set of the present disclosure comprises a central handle with a top portion and a bottom portion. In some embodiments, the bottom portion of the handle comprises two flanges: an upper flange and a bottom flange. The bottom portion of the handle may be configured to connect with a connecting hole located on the bottom of a basket component, wherein the bottom flange rests below the connecting hole and the upper flange rests above the connecting hole. It is conceived that the bottom flange of the handle is wider than the connecting hole, to an extent where the bottom flange cannot be pulled through the connecting hole. It is also conceived that the upper flange is also wider than the connecting hole, but to an extent where the upper flange can be pulled through the connecting hole with sufficient force.

In some embodiments the bottom portion of the handle is round and the connecting hole is round. As will be appreciated by those skilled in the art, however, any other shape may also create the desired connection between the handle and the basket, including but not limited to ovals or squares. In some embodiments, the bottom portion of the handle does not comprise flanges, but instead comprises alternative connection mechanisms. For example, the connection may comprise a bayonet mount wherein the male end is on either the bottom of the handle or within the basket, and wherein the female end is on the opposite component. Other embodiments are conceived and are either discussed within the present disclosure or are known by those having ordinary skill in the art.

In some embodiments, a multi-piece basket set of the present disclosure comprises a basket component having a central connecting hole, as described above. For clarification, in the detailed description of the present disclosure, the term "basket" refers to the basket component of a multi-piece basket set; the term basket and basket component can be used interchangeably. The entire integrated unit (i.e., including all sub components) shall be referred to as a set or basket set in the detailed disclosure. In some embodiments, the basket comprises a base and one or more walls extending upwardly from the base. In some embodiments, the base comprises drain holes that allow water or other liquids to flow out of the bottom of the basket. In some embodiments, the one or more walls comprise drain holes, and in some embodiments both the bottom and one or more walls comprise drain holes.

In some embodiments, the bottom and one or more walls of a basket are configured to allow a first basket to nest within a second basket. In some embodiments, the one or more walls of a basket are either vertical or slanted outward from the center of the basket such that a top basket can nest within a bottom basket. In some embodiments, a basket has an upper rim along the top of the one or more walls and a lower rim along the bottom of the one or more walls. The base of the basket may be connected to the one or more walls proximate the lower rim. In some embodiments, the upper rim may be round, the lower rim may be round, or both. It is conceived, however, that the rims may have any shape so long as the shapes allow nesting.

Referring now to the figures, wherein like reference numerals represent like parts throughout the views, exemplary embodiments will be described in detail. FIG. 1 is a top perspective view of an exemplary basket set 100 with a handle 105 and a basket 110, according to some embodiments. As seen in the figure, some embodiments of the present technology provide a handle 105 in a central location within the basket 110. As will be appreciated, a handle in the central location allows single-hand transportation. In some embodiments, and as shown throughout the drawings, a single handle 105 is connected to the basket 110. As will be appreciated, the systems and methods described in the present disclosure also allow for a plurality of handles or a single handle that connects to the basket 110 at a plurality of locations.

In some embodiments, a basket 110 may have one or more walls. In some embodiments, and as shown, a basket 110 may have a single, circular wall 115 that forms a radius around the handle 105. When referring to a wall 115, it will be understood that the wall 115 refers to outer boundary of the basket 110, wherein the wall 115 and the base 120 create an open, internal volume for holding items. Therefore, when referring to a wall 115, it will be appreciated that the wall 115 may comprise one or more wall components (e.g., a square-shaped basket may have four wall components, but the perimeter will be referred to as a wall 115). In other embodiments, and as described in more detail herein, the basket 110 and one or more walls 115 may comprise alternative shapes. In some embodiments, the wall 115 comprises drain holes 125 to allow water and other liquids to flow out of the basket 110. The drain holes 125 may be any shape that allows liquids to escape the basket. In addition to drain holes 125, some embodiments of the present design comprise decorative drain holes 130. A decorative drain hole 130 may be placed in the wall 115 in addition to the standard drain holes 125 or in lieu of the standard drain holes 125. In some embodiments, only one type of drain hole 125, 130 is present in the wall 115.

In some embodiments, a handle 105 has a top portion, a bottom portion, and a handle shaft 135 between the two portions. The bottom portion is proximate the base 120 of the basket 110; the top portion is opposite the base 120 and comprises a holding surface 140. The holding surface 140 may have any shape desirable to allow a user to grasp and hold the set 100. Examples, and not limitations, of shapes that may be used include loops, t-handles, pegs, or any other handle surface known by those with skill in the art. The present figure shows a holding surface 140 having a handle loop 145. A handle loop may have any desired shape, including the "droplet" shape shown in the figure. In some embodiments, a decorative drain hole 130 may mirror the shape of a handle loop 145. For example, the present drawing shows a decorative drain hole 130 and a handle loop 145 having a "droplet" shape. In some embodiments, the holding surface 140 comprises a cutout 150, wherein the cutout is configured decrease the amount of material necessary to form the holding surface yet maintain the surface area of the holding surface 140 for grasping and carrying.

In some embodiments, and as described herein to aid in shipping, the handle 105 and basket 110 are manufactured separately and shipped in two or more separate pieces. In FIG. 1, and in several other drawings, the set 100 is shown as one integrated set, wherein the handle 105 is attached to the basket 110. The examples shown as an integrated set 100 are exemplary consumer-facing embodiments, in accordance with some embodiments of the present disclosure. The set 100 will be assembled from its plurality of components at a point in the supply chain prior to retail sale to the customer. However, as previously described, it will be appreciated that the technology disclosed herein may also apply to retail goods, wherein the plurality of components is sold to the customer in separate components.

In some embodiments, the one or more components of the basket set 100 may be manufactured out of a plastic material. For example and not limitation, the components (i.e., handle 105, basket 110, or any other component) of a basket set 100 may be manufactured from polypropylene, high-density polyethylene, polystyrene, or any other plastic known by those having skill in the art to be desirable for a basket set 100. The water and corrosion resistance of plastic may be desirable if a basket set 100 is to be used in and around water. However, other materials besides plastics function with the present technology, and those materials are considered herein.

Figure 2:
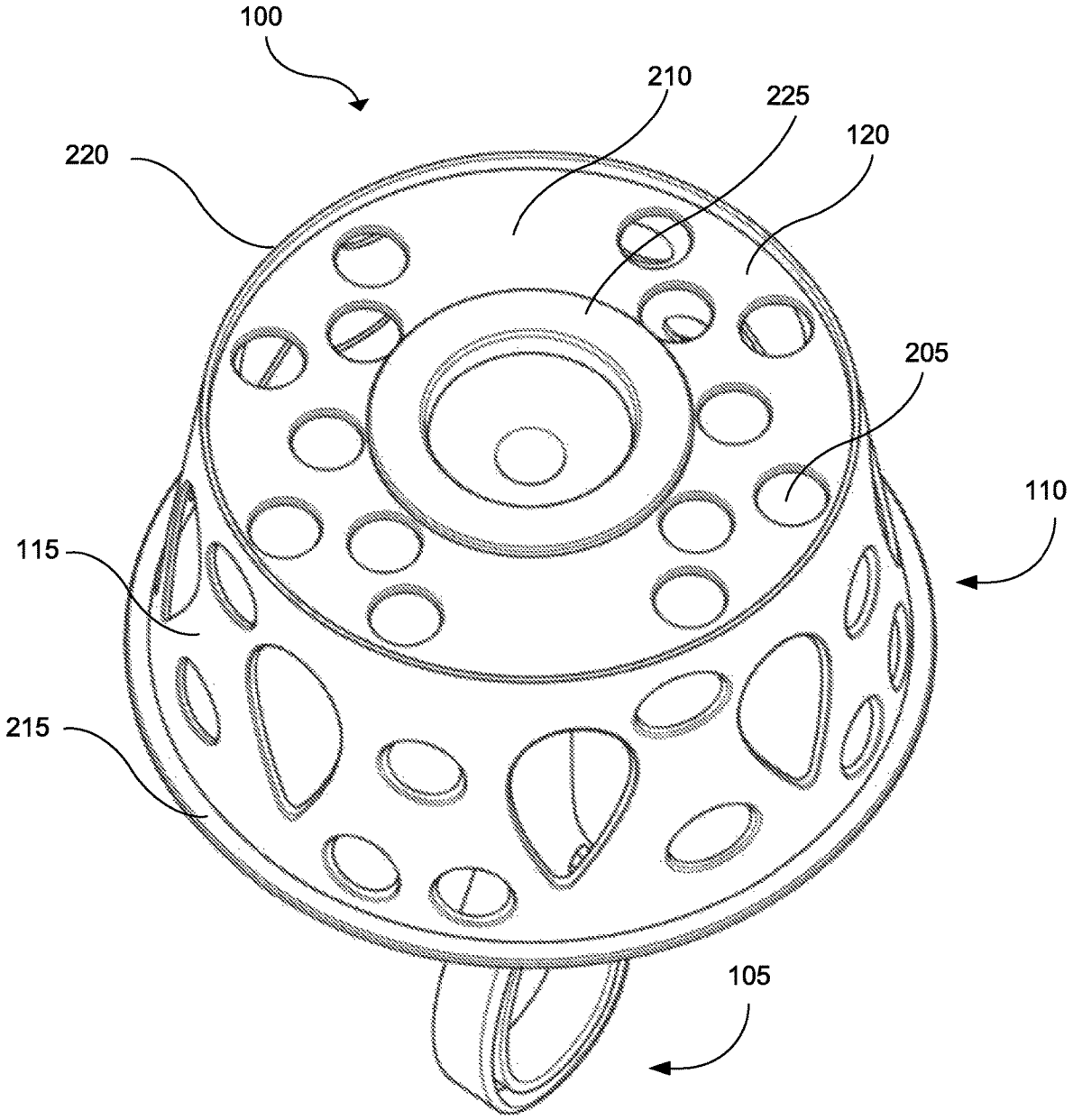
FIG. 2 is a bottom perspective view of an assembled basket set, in accordance with some embodiments of the present disclosure.

FIG. 2 is a bottom perspective view of an exemplary a basket set 100, according to some embodiments. In some embodiments, the base 120 comprises one or more bottom drain holes 205. The bottom drain holes 205 may be shaped like the drain holes 125, 130 in the wall (discussed in FIG. 1). In some embodiments, and as shown, the bottom drain holes 205 may be staggered to prevent a perforation line, or weak area, in the base 120; but any bottom drain hole 205 configure is conceived. In some embodiments, the bottom surface of the base 120 comprises one or more label areas 210, wherein the label areas 210 are free of bottom drain holes 205. The label areas 210 may be used for providing information. For example and not limitation, the labels areas 210 may be configured to display textual information. The textual information may be printed or displayed directly on the bottom surface of the base 120. In some embodiments, a decal, sticker, or other label may be placed on the one or more label areas 210 to display the textual information. As will be appreciated, the textual information that may or may not be placed on one or more label areas 210 may include, for example, safety information, manufacturer identification, recycling information, or any other information valuable to a consumer. For example, in one embodiment, the basket set 100 may be used to transport and hold child and infant bath products. In such an embodiment, it may be beneficiation to display warnings to the consumer that the basket is not a toy.

In some embodiments, the basket set 100 comprises an upper rim 215 and a lower rim 220. The upper rim 215 may be along the top portion of the wall 115, and the lower rim 220 may be along the bottom portion of the wall 115. As will be appreciated, the upper rim 215 may protrude (i.e., either towards the center of the basket 110, away from the center of the basket, or both) from the wall 115 to create both a lip for grasping and extra structural support for the top of the basket 110. In some embodiments, the lower rim 220 is proximate the base 120. In some embodiments, the lower rim 220 extends beyond the base 120 such that the base 120 is slightly inset from the lower rim 220 (as shown in the perspective view, wherein an interior surface of a wall 115 can be seen around the perimeter of the base 120). As will be appreciated, when a lower rim 220 extends beyond the base 120, the base 120 will not sit flush on a surface when the basket 110 is placed base-side-down; instead, the lower rim 220 will rest upon the surface, creating a gap between the surface and the base 120. Such an exemplary embodiment provides a space for the handle 105 to protrude through the base 120. As seen in FIG. 2, a bottom flange 225 of a handle 105 rests below the base 120. The bottom flange 225 will be discussed in greater detail in the discussions for FIGS. 6-9.

In some embodiments, the lower rim 220 does not extend beyond the base 120 but is instead flush with the base 120. As will be appreciated, this exemplary embodiment allows the base 120 to rest upon a surface when a basket 110 is placed base-side-down. To accommodate a bottom flange 225 protruding through the base 120, the base 120 may comprise an offset, wherein a portion of the base 120 is raised, thereby allowing the bottom flange 225 to protrude through the base 120 yet still allow the base 120 to rest upon a surface. In some embodiments of the present disclosure, a handle 105 does not protrude through the base 120 (i.e., an alternative connection mechanism, as will be described, is used and a flange dose not rest below the base). In embodiments where a handle does not protrude through the base 120, the base may be inset from the lower rim 220 or flush with the lower rim 220.

Figure 3:
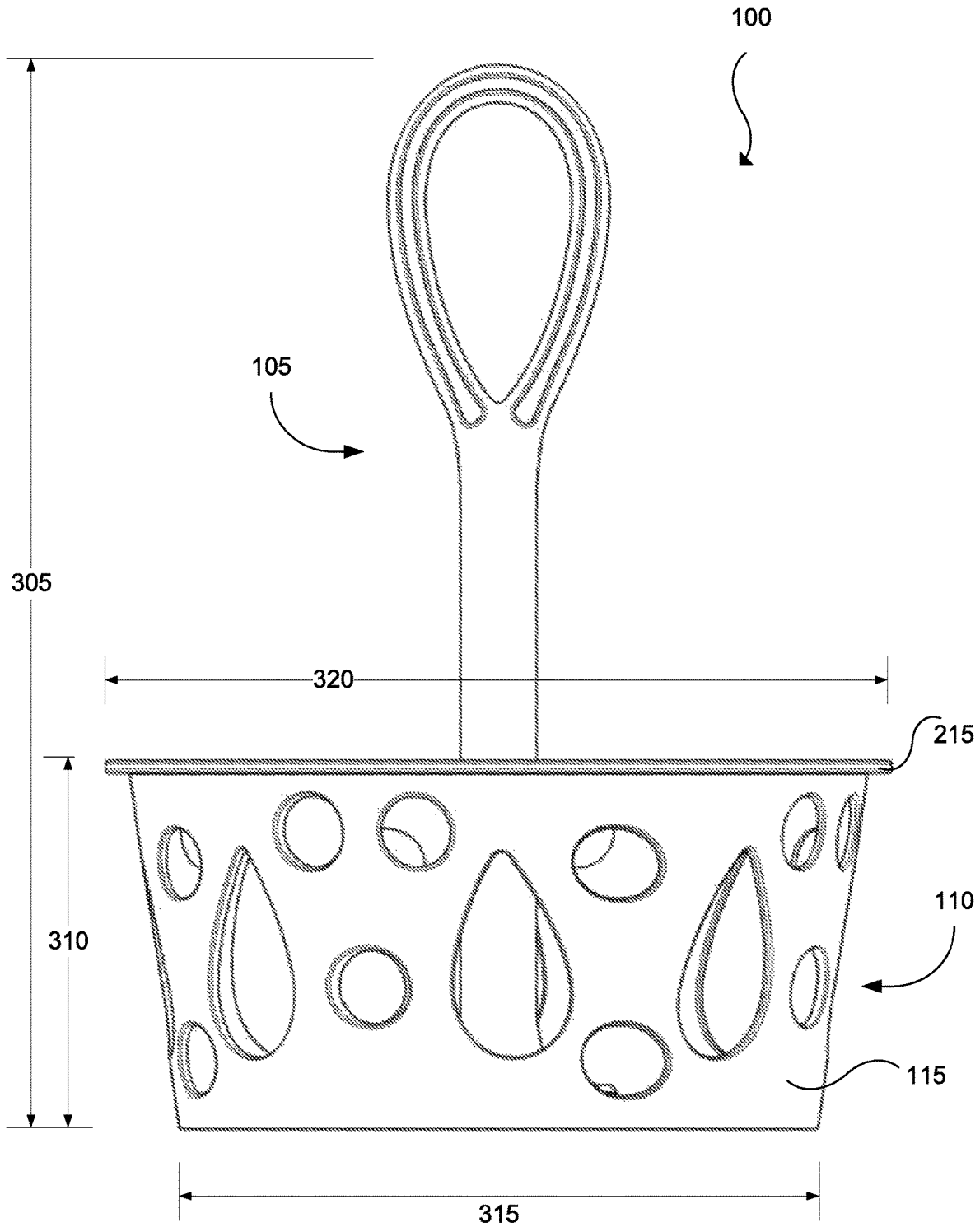
FIG. 3 is a side view of an assembled basket set, in accordance with some embodiments of the present disclosure.

FIG. 3 is a side view of an exemplary basket set 100, according to some embodiments. Embodiments of the present disclosure have a total assembled height 305. The total assembled height 305 corresponds to the height from resting surface of the basket 110 to the top of the holding surface 140 of the handle 105. As will appreciated, the total assembled height 305 depends on what goods or items are to be stored within the basket 110. For example and not limitation, if a bath soap bottle has an average height of approximately 175 mm, it would be beneficial that the top of the holding surface 140 extend above the top of the of the bath soap bottle a few centimeters to aid in grabbing the handle (i.e., 4 cm—for a total assembled height 305 of approximately 215 mm). It is also conceived that numerous other items may be transported by an embodiment of the present disclosure. Therefore, it is conceived that total assembled height 305 may range from about 100 mm to about 300 mm. However, these are not limitations, and it will be appreciated that the total assembled height 305 may be of any range that may benefit from the features of a basket set 100 described herein.

Embodiments of the present disclosure have a basket height 310. The basket height 310 may be within any range, but it is conceived that the basket height 310 is less than the total assembled height 305. Again, as will appreciated, the basket height 310 depends on what goods or items are to be stored within the basket 110. For example and not limitation, if a bath soap bottle has an average height of approximately 175 mm, it would be beneficial that the basket height 310 extent partially up the height of the bath soap bottle, for example 75 mm, so that the bottle will not easily fall from the basket 110. Therefore, it is conceived that basket height 310 may range from about 50 mm to about 150 mm. However, these are not limitations, and it will be appreciated that basket height 310 may be of any range that may benefit from the features of a basket set 100 described herein.

Embodiments of the present disclosure have a basket base width 315. The basket base width 315 represents the maximum footprint of the basket 110. The basket base width 315 does not represent the internal width of the basket at the base (from this view, the internal width cannot be seen). The internal width of the basket at the base will be several millimeters smaller than the basket base width 315, depending on the thickness of the wall 115. It is conceived that the wall 115 has a thickness of approximately 1 mm to 3 mm; therefore, the internal width of the basket will be approximately 2 mm to 6 mm less than the basket base width 315. The internal width of the basket is discussed in greater detail in FIG. 5.

As will appreciated, the basket base width 315 may have any range of values. In some embodiments, the basket base width 315 may be small so as to decrease the footprint of the basket 110 and allow it to fit in smaller areas, for example and not limitation, the corner of a bathtub. In some embodiments, the basket base width 315 may be large so as to increase its equilibrium. For example, when a total assembled height 305 is large, it may be beneficial to have a larger basket base width 315 so that a greater force (i.e., torque) is needed to be applied to the handle 105 to upend the basket set 100. Therefore, it is conceived that basket base width 315 may range from about 75 mm to about 300 mm. However, these are not limitations, and it will be appreciated that basket base width 315 may be of any range that may benefit from the features of a basket set 100 described herein.

Embodiments of the present disclosure have a basket top width 320. The basket top width 320 corresponds to the diameter from one edge of the upper rim 215 to another. Again, as will appreciated, the basket top width 320 depends on what goods or items are to be stored within the basket 110. It is conceived that the basket top width 320 may range from about 100 mm to about 350 mm. The one limitation is that the basket top width 320 should be larger than the basket base width 315 (and the top opening width as discussed further in FIG. 5). The reason for this larger width is to aid in nesting capabilities, which will be appreciated by those in the art and will be described in more detail in the detailed discussion accompanying FIG. 10.

Figure 4:
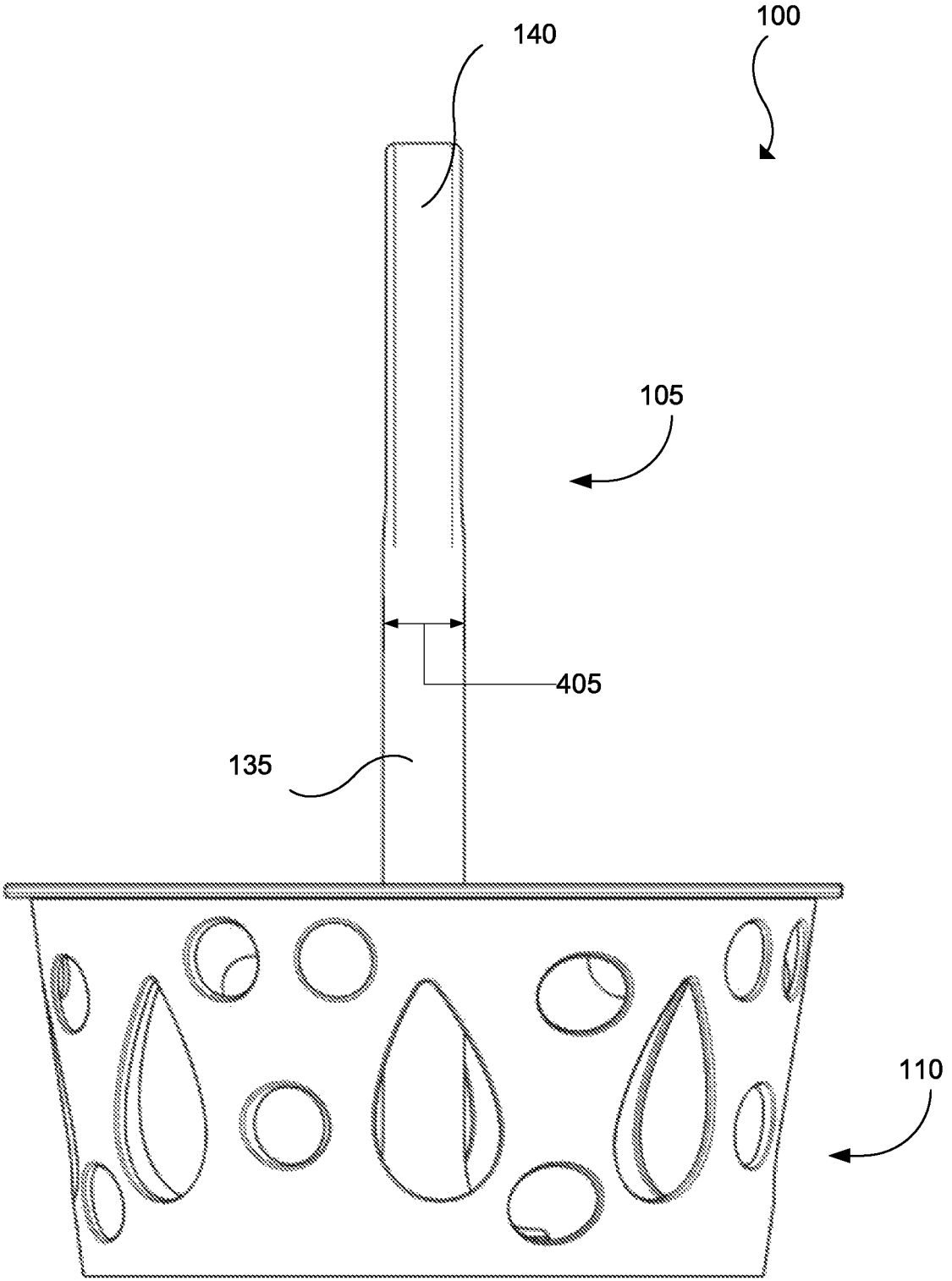
FIG. 4 is a side view of an assembled basket set from an alternative angle, in accordance with some embodiments of the present disclosure.

FIG. 4 is a side view of the exemplary basket set 100 shown in FIG. 3, but wherein the exemplary embodiment in FIG. 3 is rotated 90 degrees, according to some embodiments. Embodiments of the present disclosure have a handle shaft width 405. The handle shaft width 405 may be any range. As will be appreciated, the handle shaft width 405 will depend on the characteristics desired for an elongated handle 105. For example, the handle shaft width 405 may be small as to provide more room around the handle 104 within the basket 110; the handle shaft width 405 may be large as to allow greater handle 105 strength when carrying multiple items within the basket 110. It is conceived that the handle shaft width 405 may comprise a thickness of from between about 5 mm to about 50 mm. However, these are not limitations, and it will be appreciated that handle shaft width 405 may be of any range that may benefit from the features of a basket set 100 described herein.

In some embodiments and as shown, the holding surface 140 may taper inwardly from the handle shaft 135. Although the taper is not essential for a device described in the present disclosure, the taper may be beneficial when the handle shaft width 405 is of significant size, thereby providing a smaller holding surface 140 for grasping.

Figure 5:
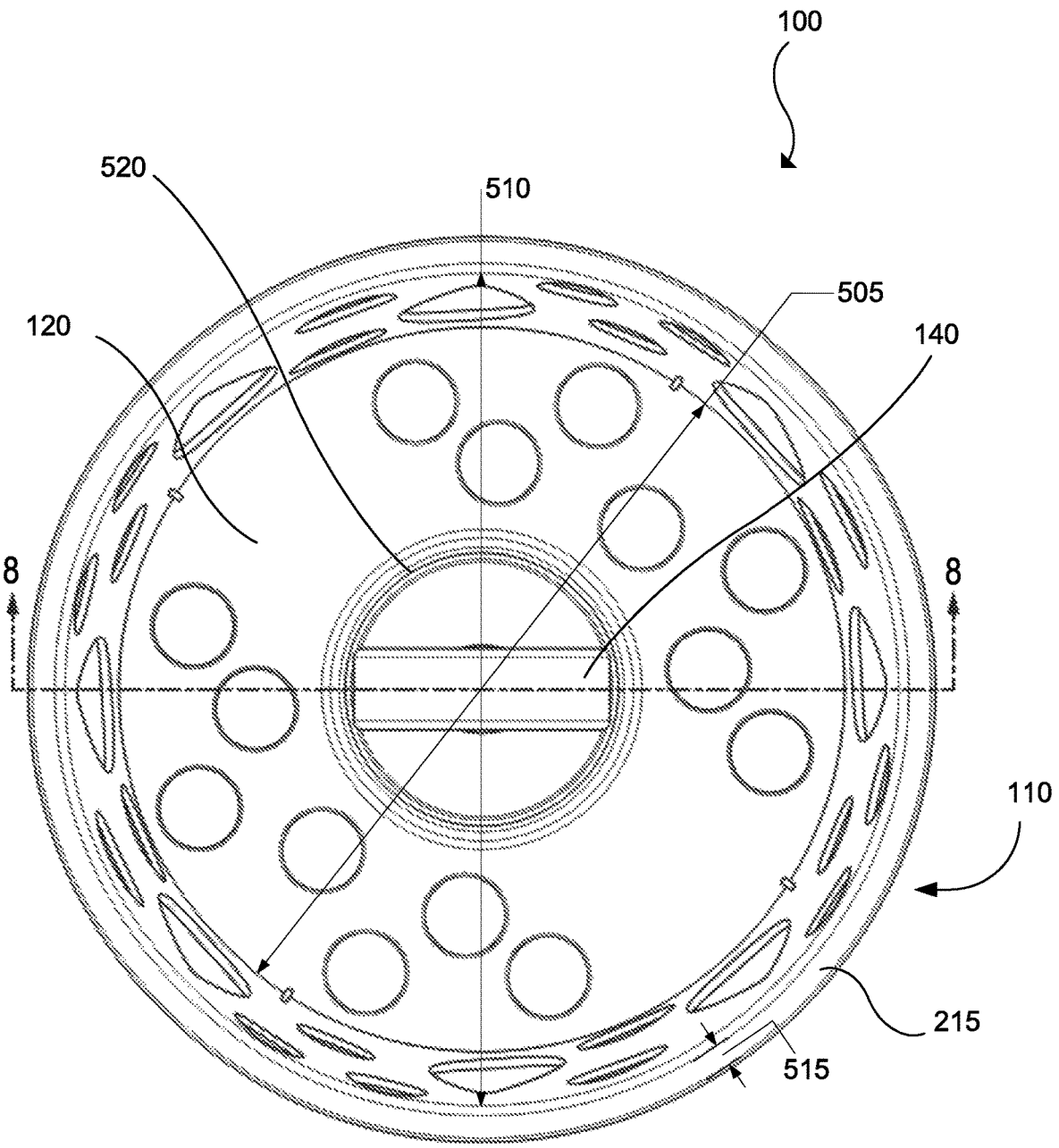
FIG. 5 is a top view of an assembled basket set, in accordance with some embodiments of the present disclosure.

FIG. 5 is a top view of an exemplary assembled basket set 100, according to some embodiments. Embodiments of the present disclosure have a basket internal base width 505, as introduced in the discussion for FIG. 3. The same considerations are true for this width as with others previously discussed: the width must be sufficient to hold items of interest. It is conceived that the basket internal base width 505 may be of from about 75 mm to about 300 mm. However, again, these are not limitations and other ranges are conceived.

Embodiments of the present disclosure have a top opening width 510. The top opening width 510 differs from the basket top width 320 (discussed in FIG. 3) in that the top opening width 510 is the internal width of the basket opening. The basket top width 320 also includes a rim width 515 of an upper rim 215. The rim width 515 creates both a lip for grasping and extra structural support for the top of the basket 110. It is conceived that the rim width 515 is within a range of from about 3 mm to about 30 mm, but other ranges are considered, as will be appreciated by those having skill in the art.

In some embodiments, the top opening width 510 has a diameter of from about 100 mm to about 350 mm, depending on the items to be stored within the basket 110. One limitation is that the top opening width 510 should be equal to or greater than the basket base width 315 (shown in FIG. 3). By having a top opening width 510 equal to or larger than the basket base width 315, a second basket may slide into the basket 110, thus aiding in nesting capabilities. The nesting capabilities are described in more detail in the detailed discussion accompanying FIG. 10.

In some embodiments, the basket 110 comprises a connecting hole 520. The connecting hole 520 may be located within the base 120 of the basket 110. In the figure, the hole itself is obstructed by the base of a handle; the hole is shown and described in greater detail in FIG. 7. In some embodiments, the connecting hole 520 is configured to attach the basket 110 to a handle. In some embodiments, the connecting hole 520 has a larger width than the holding surface 140. This exemplary embodiment allows the holding surface 140 to pass through the connecting hole 520 so that the bottom portion of the handle (not shown in this top view) may attach to the connecting hole 520.

In some embodiments and as shown, the basket 110 comprises a round shape. As will be appreciated, many other shapes are acceptable for the presently-disclosed technology. For example and not limitation, the basket 110 may be oval, square, heart-shaped, star-shaped, or any other shape that comprises these described features and is configured to allow two or more baskets to nest.

Figure 6:
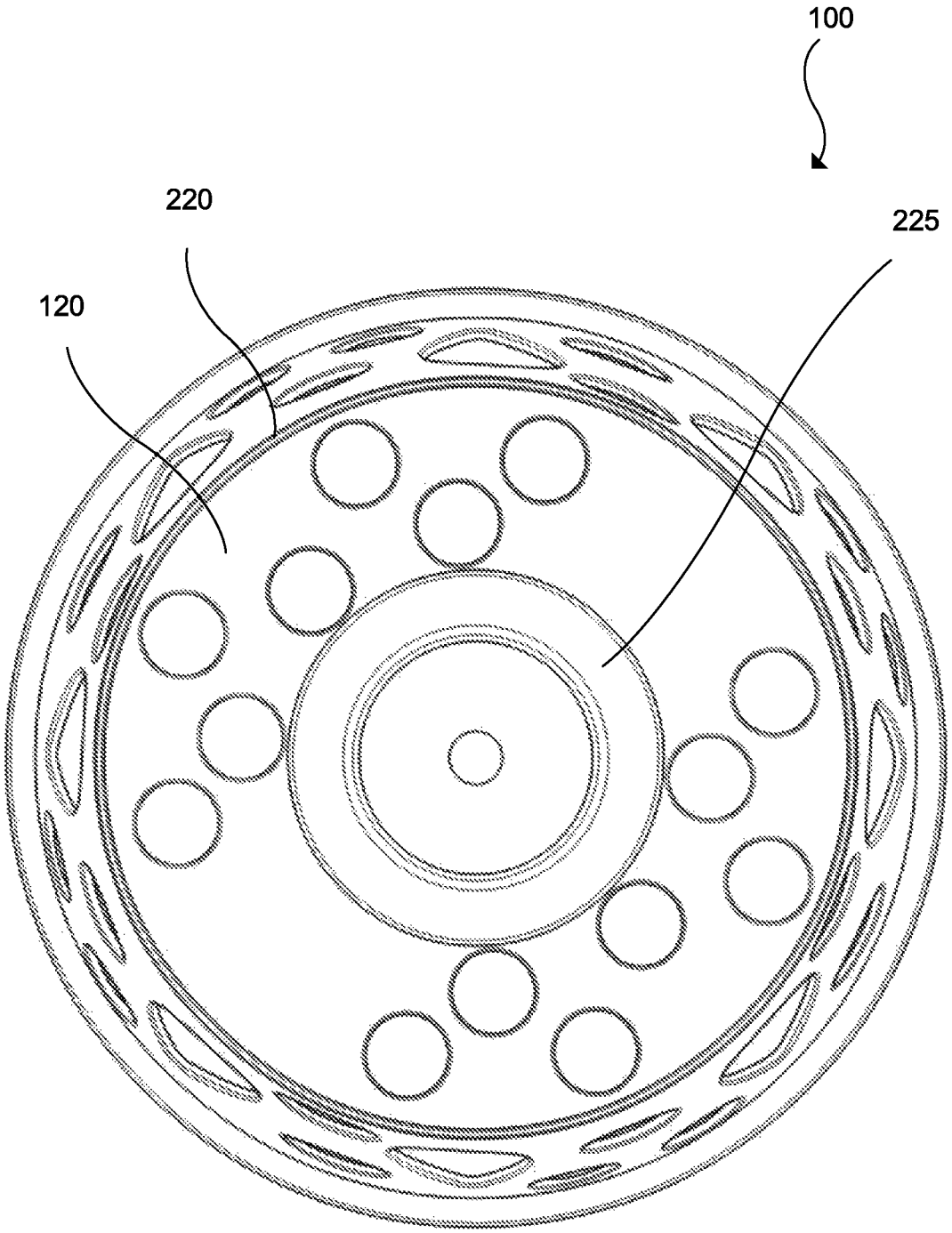
FIG. 6 is a bottom view of an assembled basket set, in accordance with some embodiments of the present disclosure.

FIG. 6 is a bottom view of an exemplary assembled basket set 100, according to some embodiments. In some embodiments, a bottom flange 225 of a handle rests below the bottom surface of the basket base 120. In some embodiments, the diameter of the bottom flange 225 is larger than a connecting hole 520 (not shown because of the smaller diameter). In such embodiments, the bottom flange 225 prohibits the handle from being pulled through the connecting hole 520 any farther than the flange.

As previously described and as shown in the exemplary embodiment in FIG. 6, the lower rim 220 may extend beyond the base 120 such that the base 120 is slightly inset from the lower rim 220. Although such an embodiment is not essential to a basket set 100, an inset base 120 provides space for a bottom flange 225 protruding through the base 120.

Figure 7:
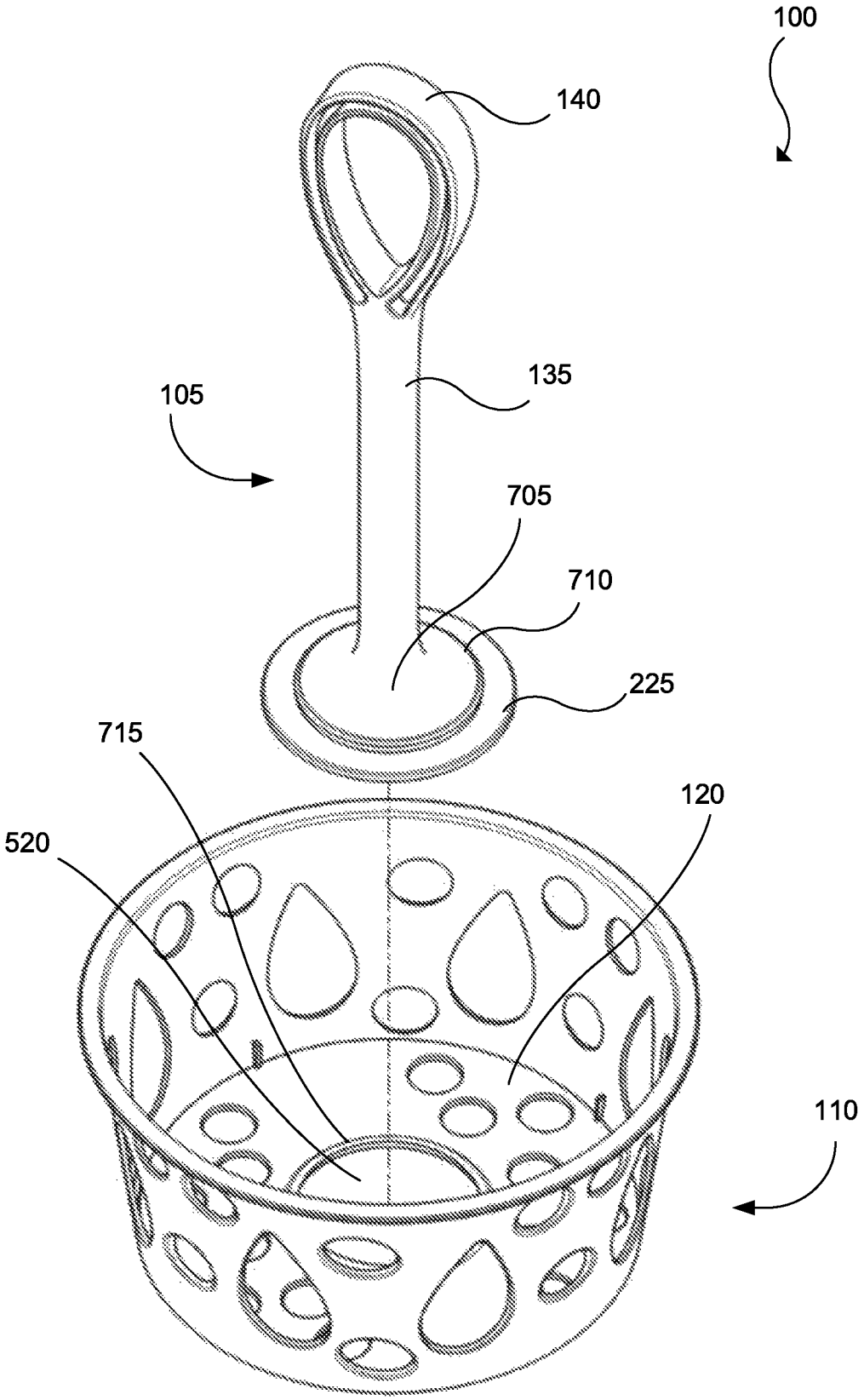
FIG. 7 is a perspective view of a disassembled basket set, showing a handle component above a basket component, in accordance with some embodiments of the present disclosure.

FIG. 7 is a perspective view of an exemplary disassembled basket set 100, according to some embodiments. In some embodiments, the handle 105 and the basket 110 are shipped separately and assembled at a point in the supply chain prior to retail sale to a customer. The drawing shows two components of a basket set 100, although a basket set 100 may comprise more than two components. For example and not limitation, the handle 105 may comprise multiple components (e.g., the holding surface 140 may be separate from the handle shaft 135).

In some embodiments, a handle comprises a handle base 705, wherein the handle base 705 comprises one of any number of connection mechanisms configured to connect the handle 105 to the basket 110. In some embodiments and as shown, a connection mechanism may comprise flanges configured to restrict movement of the handle 105 though a connecting hole 520. In such an embodiment, the handle 105 passes through the connecting hole 520 of the basket 110 and connects to the connecting hole 520 at the handle base 705. In FIG. 7, the dashed line does not indicate the direction in which the handle 105 will be inserted into the base 120 of this embodiment; instead, the handle 105 will pass through the bottom of the basket 110 in the present figure. As will be appreciated, in a design where the handle 105 passes through the connecting hole 520, the handle surface 140 must be smaller than the connecting hole 520 or be otherwise configured to pass through the connecting hole 520.

In some embodiments, a handle base 705 comprises an upper flange 710 and a bottom flange 225. The upper flange 710 and the bottom flange 225 both have widths (or diameters in the case of a round embodiment, as shown) larger than the width of a connecting hole 520. When a handle 105 is inserted through a connecting hole 520, the handle 105 will be pulled until the upper flange 710 contacts the bottom of the connecting hole 520. The handle 105 will then be pulled with sufficient force to overcome the resistance created by the upper flange 710 having a greater width than the connecting hole 520, and the upper flange 710 will pass through the connecting hole 520. The bottom flange 225 will then contact the bottom of the connecting hole 520. As will be appreciated, in some embodiments, the bottom flange 225 has a greater width than the upper flange 710. This greater width of the bottom flange 225 will prohibit the handle 105 from being pulled any farther through the connecting hole 520. In this embodiment, the handle 105 will, at this point, be rigidly connected to the basket 110 at the connecting hole 520.

In some embodiments, a base 120 comprises a connecting ring 715 around the perimeter of the connecting hole 520. When a handle 105 is pulled through a connecting hole 520, it may be beneficial for the perimeter of the connecting hole 520 to be stronger than the rest of the base 120. For example, the base 120 may be produced in a thin plastic or other material so as to decrease the amount of material used, but it may be desired to have a stronger surface at the connection mechanism. A connecting ring 715 may serve this purpose by providing a thicker base around the perimeter of the connecting hole 520 to increase the integrity of the connection between the handle 105 and the base 120. This embodiment is shown in greater detail in FIG. 8. A thinker connecting ring 715 is, however, not essential for a functioning basket set 100.

In some embodiments, the connection mechanism between the handle 105 and basket 110 does not comprise flanges. For example and not limitation, in some embodiments, the handle base 705 comprises a male or female side of a bayonet mount, and the base 120 of the basket 110 may comprise the corresponding female or male side of a bayonet mount. To provide the axial, springing force needed to create a rigid and fixed bayonet mount, at least one of the handle base 705 and the base 120 of the basket set 100 may comprise a separating mechanism to push one component from the other. For example, at least one of the handle base 705 and base 120 may comprise a plastic flange that will deform when the two components are pressed together, thereby creating the spring tension necessary to produce a locked bayonet mount. Other designs can provide the spring tension necessary for a bayonet mount; those designs are considered. In an embodiment where the connection mechanism is a bayonet mount, the embodiment must account for the intended use of the basket set 100. For example, if a basket set 100 is to be used for transporting child and infant goods, the design must consider the safety of the child or infant. Therefore, in some embodiments, the bayonet mount is strong enough to resist the wrist-twisting strength of, for example, a child under the age of three. One example would be a bayonet mount that does not malfunction when a particular torque (e.g., 2 Nm, 4 Nm, 6 Nm, 8 Nm, or 10 Nm) is applied to the handle 105.

Another exemplary connection mechanism is a threaded connection between the handle base 705 and base 120. For example, the handle base 705 may comprise the male or female threads of a threaded connection, and base 120 may comprise the corresponding female or male threads of a threaded connection. However, in such an embodiment, the same considerations for intended use as described above must be made. As will be appreciated, if child safety is a concern, the same torsional resistance considerations as described above must be made. In some embodiments, other connection mechanisms are used for the presently disclosed technology, and those connection mechanisms are well known in the art and are considered herein.

Figure 8:
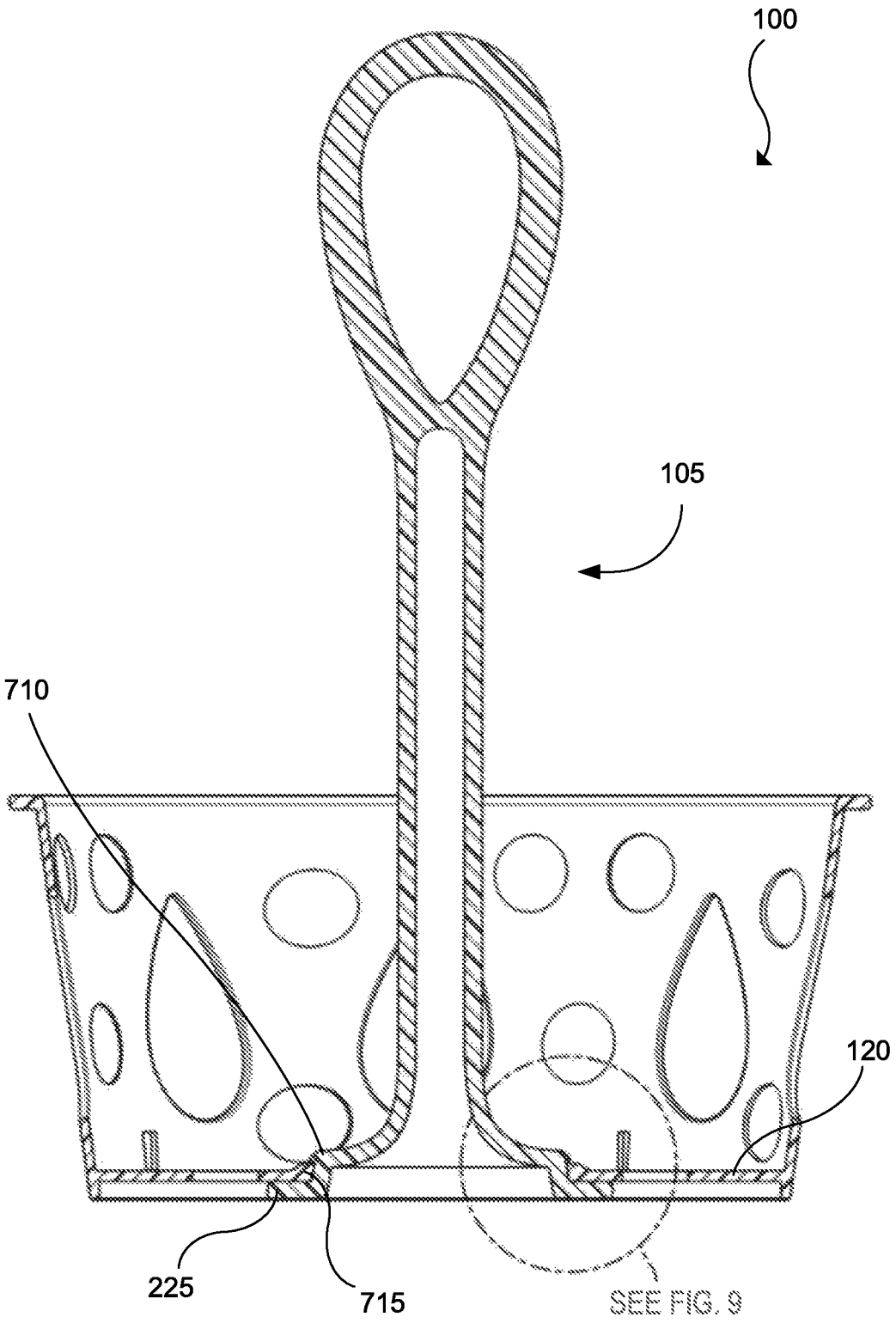
FIG. 8 is a cross-section view of an assembled basket set, showing an exemplary connecting mechanism, in accordance with some embodiments of the present disclosure.

FIG. 8 is a cross section of the embodiment shown in FIG. 5, taken through the center of the basket set 100 and through the center of the handle surface 140, according to some embodiments. The embodiment shown in the figure comprises a connection mechanism having two flanges, as previously disclosed. In FIG. 8, the upper flange 710 and bottom flange 225 both have widths (i.e., diameters because the components are round in this exemplary embodiment) greater than the width of the connecting hole 520. Although a connecting hole 520 cannot shown in this two-dimensional cutout view, the perimeter of the hole in the present figure is shown by a connecting ring 715. In some embodiments and as shown, the connecting ring 715 is thicker from top to bottom than the remainder of the base 120, thereby creating a stronger surface at the point of connection.

To assemble the exemplary embodiment depicted in FIG. 8, a handle 105 is pulled through the hole in the base 120 until the upper flange 710 contacts the connecting ring 715. Because the upper flange 710 is wider than the connecting ring 715, sufficient force is needed to pull the upper flange 710 through the connecting ring 715. Once the upper flange 710 passes through the connecting ring 715, the bottom of the connecting ring 715 contacts the bottom flange 225. In some embodiments, the bottom flange 225 has a greater width than the upper flange 710. In some embodiments, the wider bottom flange 225 prohibits the handle from being pulled any farther through the hole at the connecting ring 715. At this point, the connecting ring 715 rests between two flanges, thus creating a rigidly-assembled construct.

Figure 9:
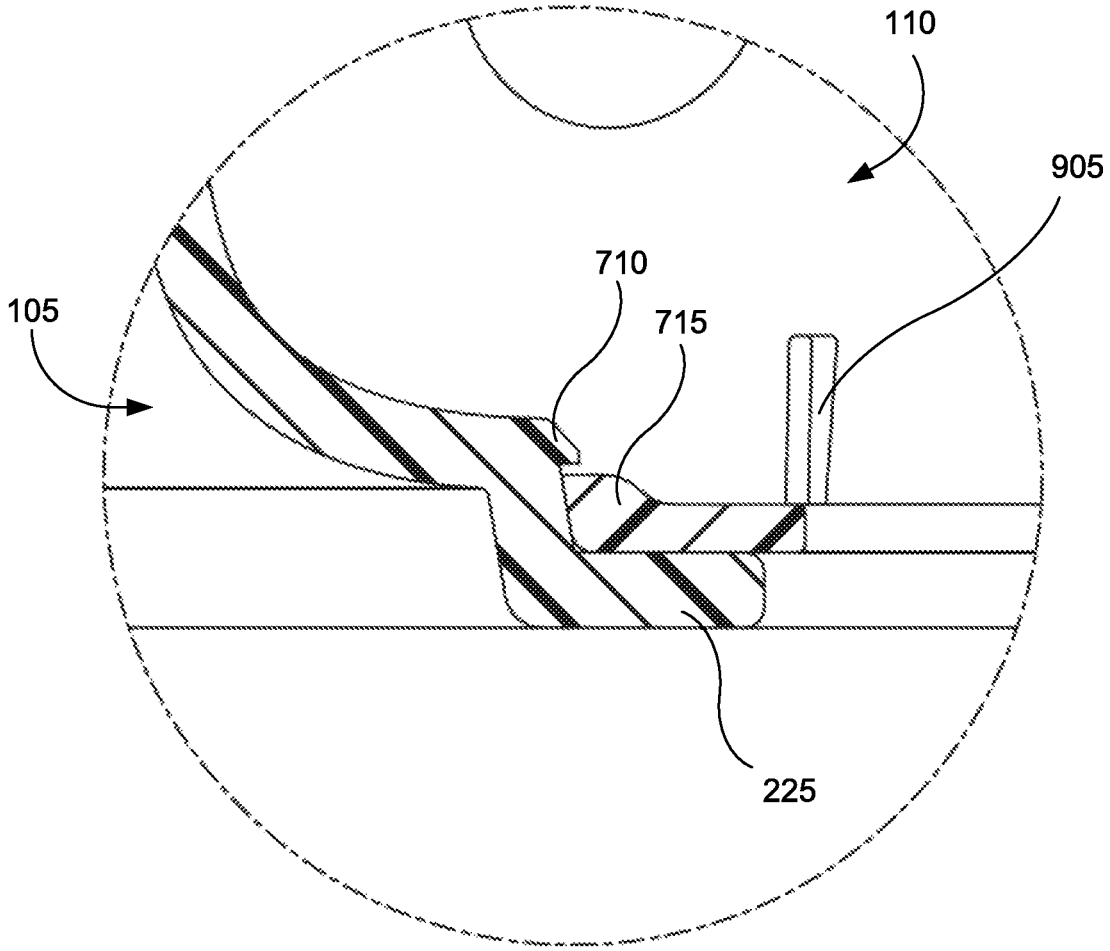
FIG. 9 is a detail view of an exemplary connecting mechanism, in accordance with some embodiments of the present disclosure.

FIG. 9 is a detail view of the exemplary connecting mechanism shown in FIG. 8, according to some embodiments. The embodiment shown in FIG. 9 is an already-assembled basket set, wherein the upper flange 710 has been pulled through a connecting ring 715 (a connecting hole is not shown in this two-dimensional cutout). The connecting ring 715 in the figure now rests between the upper flange 710 and bottom flange 225.

In some embodiments, once a basket set is assembled, it may be desirable for the components to resist disassembly. For example, if a basket set is to be used for child and infant bath products, it may be desirable that a handle 105, once assembled, not disconnect from a basket 110. A non-removable handle 105 may aid in preventing a child from fitting his or her hand within an open connecting hole. Considering these design aspects, in some embodiments of the present design, a connecting mechanism is configured to resist disassembly. In some embodiments, an upper flange 710 may be configured resist disassembly by having a width sufficient to resist the upper flange 710 from being pulled back through a connecting ring 715 once assembled. As will be appreciated, an embodiment using a width differential as a connection mechanism must consider both the amount of force required to assemble the components and the amount of force required to disassemble the components; if the width difference between the upper flange 710 and the connecting hole is too great, it may be difficult or impossible to pull the upper flange 710 through a connecting hole to assemble the set. It is conceived, therefore, that the upper flange 710 may have a width that is of from about 0.25 mm to about 2.00 mm larger than the width of the connecting hole (or connecting ring 715 in the present embodiment). In other words, in the embodiment shown in FIG. 9, the upper flange 710 may overhang the connecting ring 715 by about 0.125 mm to about 1.00 mm. For example and not limitation, an upper flange 710 may have a diameter of 48.00 mm and a connection hole may have a diameter of 47.40 mm. In this embodiment the upper flange 710 is 0.6 mm wider than the connecting hole (i.e., the flange overhangs the connecting ring 715 by 0.3 mm); this embodiment may aid assembly yet also resist disassembly. Although these dimensions may be beneficial for a system as described herein, the dimensions are merely exemplary, and any other range is conceived, depending on the design features desired for the system.

In some embodiments, the shape of the upper flange 710 may aid assembly yet resist disassembly. For example and not limitation, as shown in FIG. 9, the top of an upper flange 710 may comprise a beveled edge, and the bottom of an upper flange 710 may comprise a sharp angle. A beveled top may facilitate pulling an upper flange 710 through a connecting hole, yet a sharp-angled bottom may prohibit pulling the upper flange 710 back through a connecting hole.

In some embodiments, a spacing tab 905 is placed along the perimeter of the base 120 of the basket 110 to aid in nesting capabilities. A more detailed description of exemplary spacing tabs is provided in the discussion for FIGS. 10-11.

Figure 10:
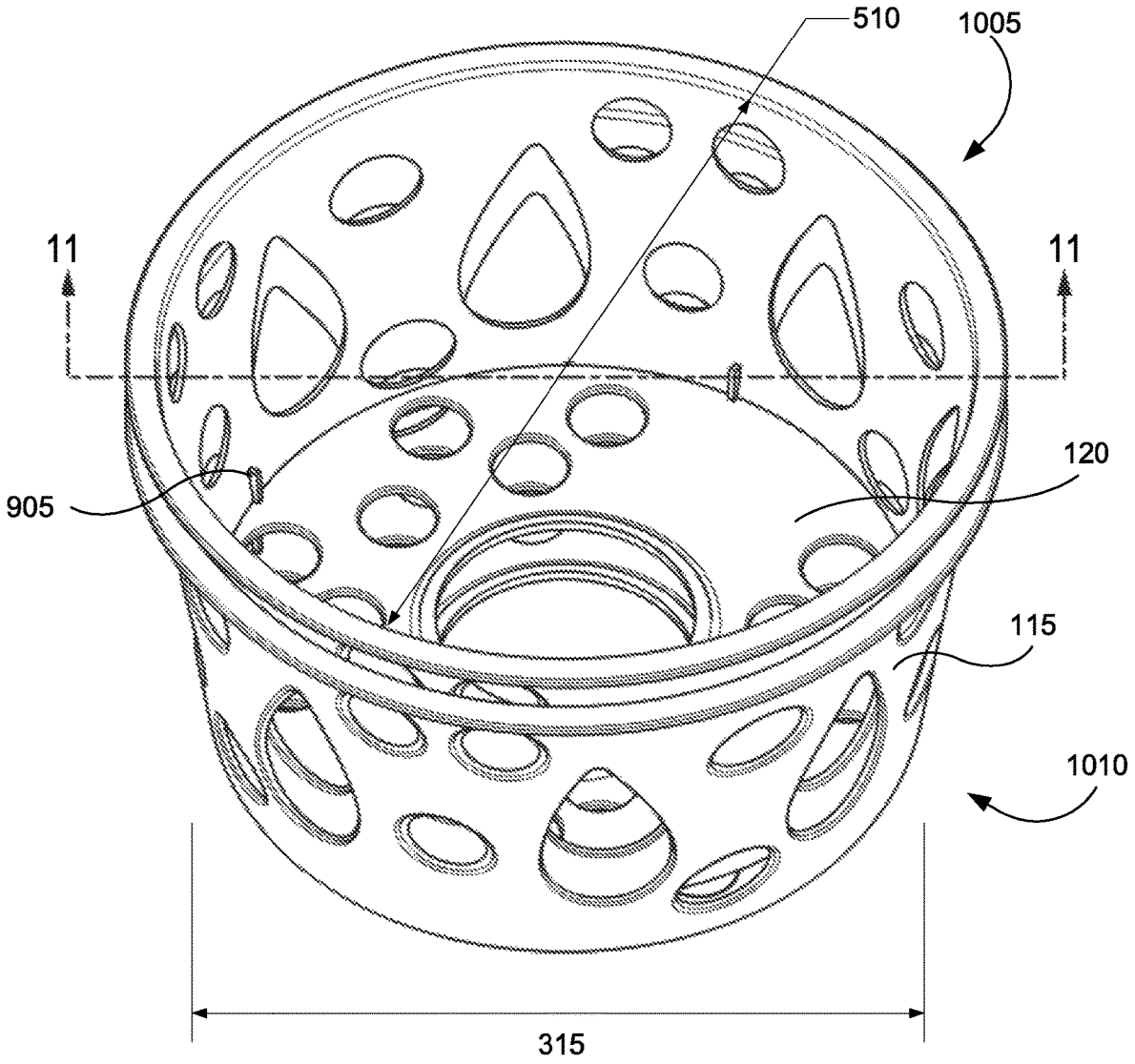
FIG. 10 is a perspective view of two nested basket components, in accordance with some embodiments of the present disclosure.

FIG. 10 is a perspective view of two nested baskets, in accordance with some embodiments. As previously described, shipping costs are directly related to the volume required to ship a product. Therefore, it may be desirable for a basket set as described herein to be able to nest within another basket set during shipment. FIG. 10 is an example of a nestable configuration. In some embodiments, a first basket 1005 may fit within the interior volume of a second basket 1010. In this embodiment, less space is wasted within the interior volume of any given basket because one or more baskets fill the interior volume.

As previously described, nesting capabilities of two baskets depends a great deal on the dimensions and/or shape of a basket. In some embodiments a basket base width 315 is smaller than a top opening width 510. By being smaller at the base than at the top opening, a first basket 1005 may slide freely into a second basket 1010. In such an embodiment, and as shown, the smaller width at the bottom of the basket and the larger width at the top of the basket creates a slight slope or slant to the walls 115 of each basket.

In some embodiments, the walls 115 of a basket may comprise a spacing tab 905 located proximate the base 120. A spacing tab 905 may be used to maintain separation between a first basket 1005 and a second basket 1010. In some embodiments, it may be desirable to maintain some space such that the bottom of a first basket 1005 does not rest on the base 120 of a second basket 1010. For example and not limitation, a design feature on the bottom of a basket, i.e., a flare at a lower rim 220 (not shown in this figure), may prohibit a first basket 1005 from seating completely into a second basket 1010. In some embodiments, a spacing tab 905 may be employed to maintain separation to resist a first basket 1005 from wedging tightly in a second basket 1010.

Figure 11:
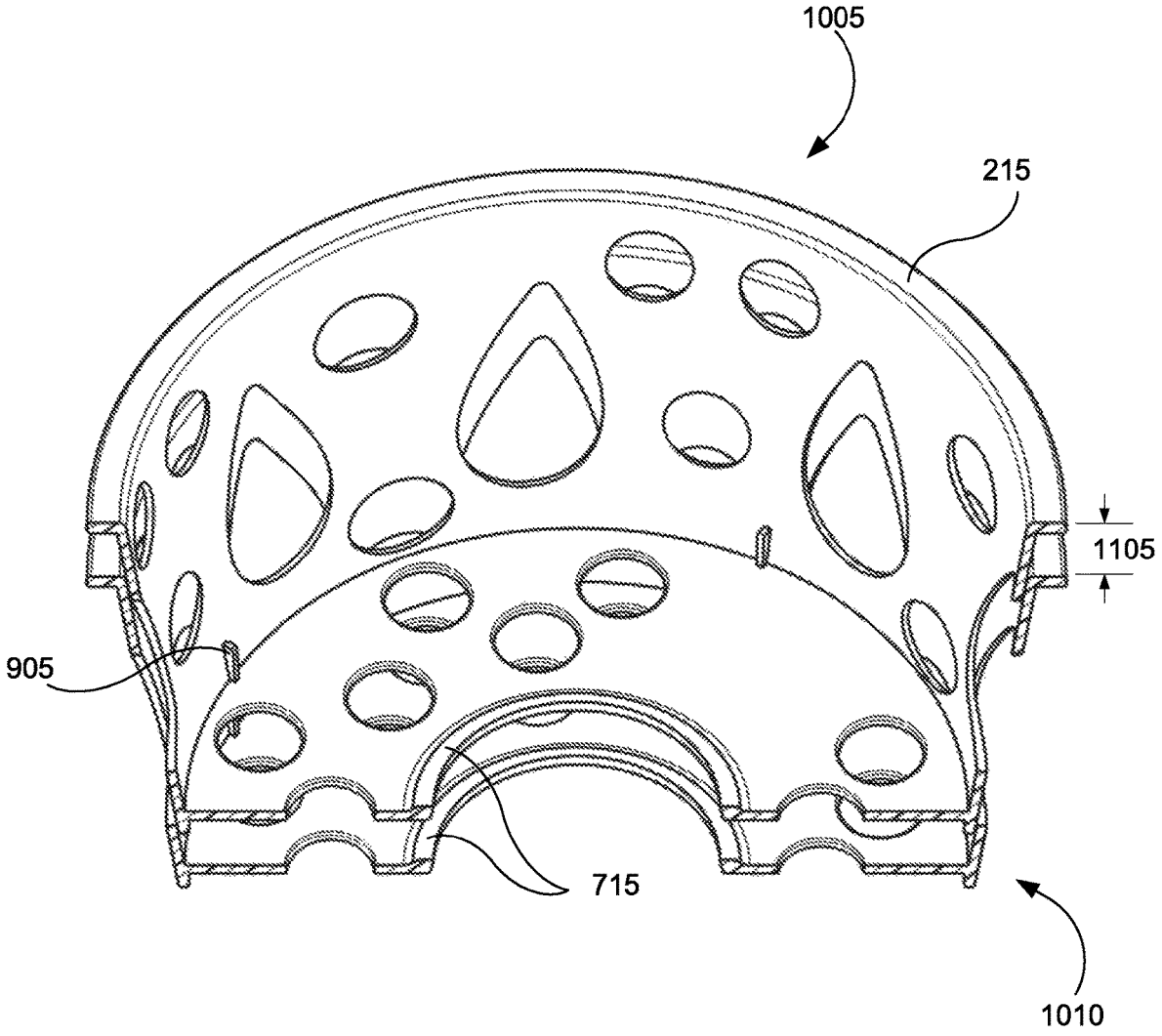
FIG. 11 is a cross-section view of two nested basket components, in accordance with some embodiments of the present disclosure.

FIG. 11 is a cross section of the embodiment shown in FIG. 10, taken through the center of the first basket 1005 and the second basket 1010, according to some embodiments. The cross section provides a view of baskets comprising a connecting ring 715. Also shown in the exemplary embodiment is two baskets having a widened upper rim 215, providing structural support to the upper walls of the baskets. The exemplary embodiment also shows a gap 1105 between the upper rims 215 of the first basket 1005 and the second basket 1010. The gap 1105 may be provided by a spacing tab 905, as shown here and as described above.

Figure 12:
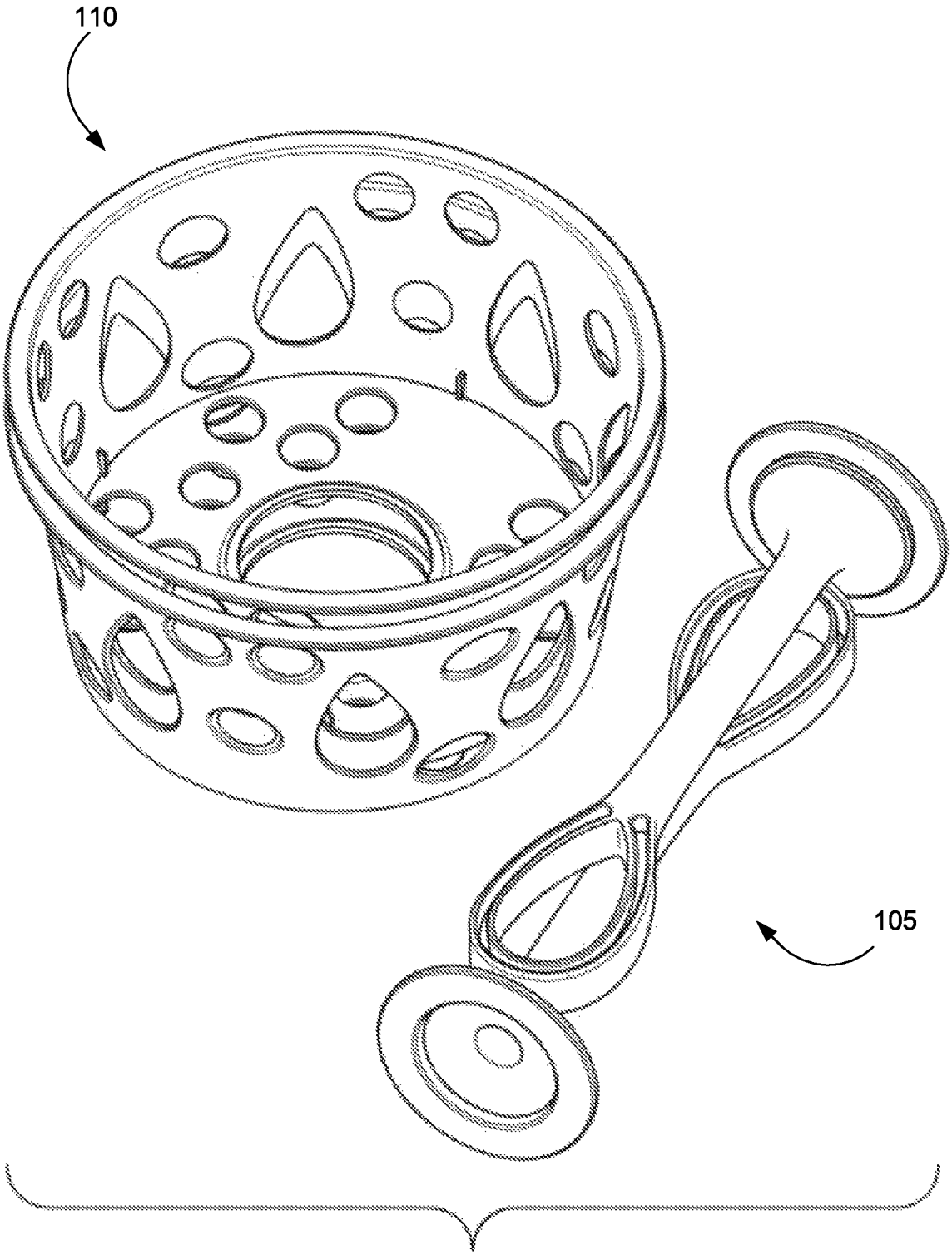
FIG. 12 is a perspective view of two basket components and two handle components, in accordance with some embodiments of the present disclosure.

FIG. 12 is a perspective view of two basket components and two handle components, according to some embodiments. As previously discussed in this disclosure, aspects of the current design and methods provide a basket set for carrying goods, wherein the basket set both has a centrally-placed handle and minimizes shipping volume. As shown in FIG. 12, one embodiment of the present disclosure is to provide two components: a basket 110 and a handle 105. The exemplary embodiment shown in FIG. 12 depicts one way in which the volume-saving design is realized. A plurality of baskets 110 are nested within each other and are packaged for shipment. A plurality of handles 105 are collected and packaged for shipment. After shipment, one handle 105 may be inserted into one basket 110 to create a single basket set. Other embodiments are conceived and are described in greater detail in the present disclosure.

Figure 13:
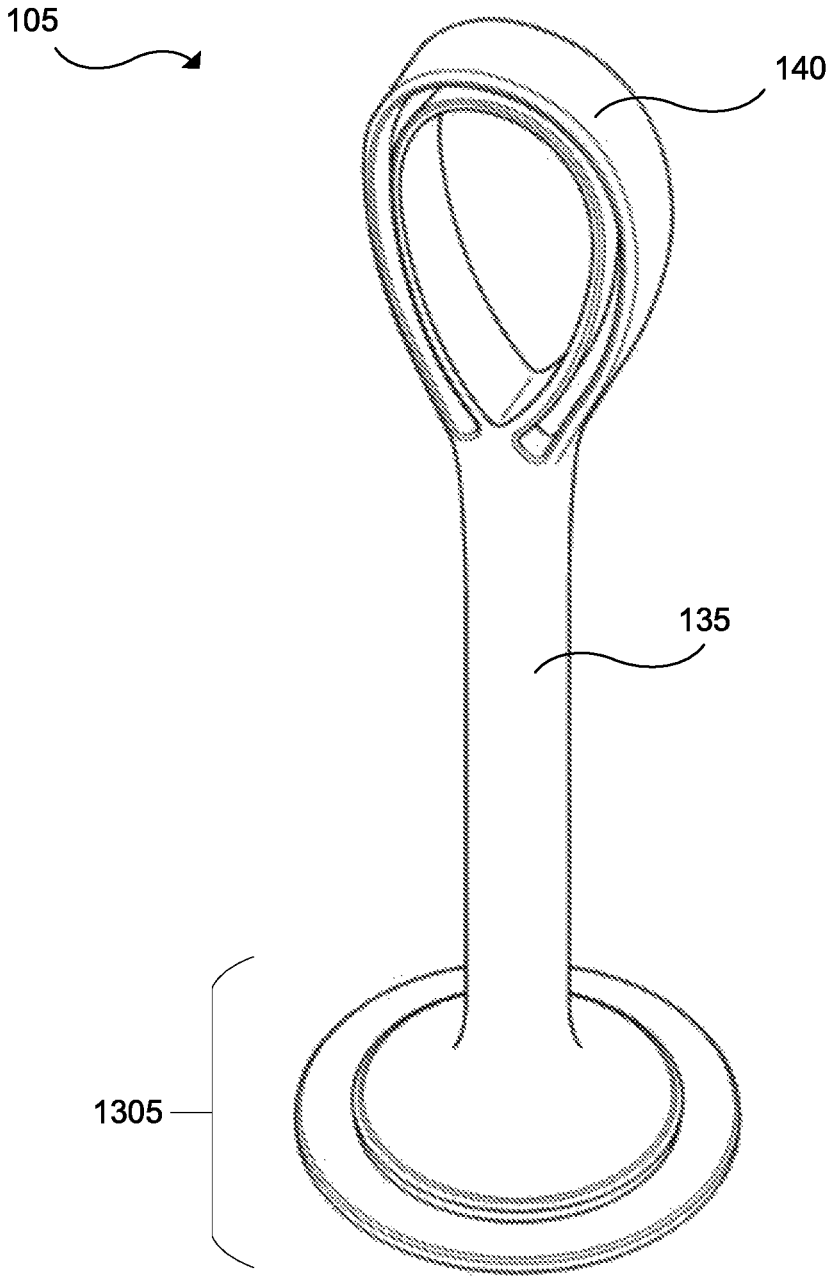
FIG. 13 is a perspective view of a single handle component, in accordance with some embodiments of the present disclosure.

FIG. 13 is a perspective view of a single handle 105, according to some embodiments. In some embodiments and as shown, a handle 105 is one single piece. However, other embodiments are conceived. For example and not limitation, in some embodiments, the holding surface 140 is separate from the handle shaft 135. In some embodiments, the handle shaft 135 may be separate from a handle connection mechanism 1305 at the bottom of the handle 105. In some embodiments, the holding surface 140 comprises additional gripping features, e.g., dimples, ribs, rubber strips, or any other feature known in the art that would help facilitate extra friction between a hand and a holding surface 140. Also shown in the figure is a handle connection mechanism 1305 comprising two flanges. Other handle connection mechanisms 1305 are conceived and are described in greater detail herein.

Figure 14:
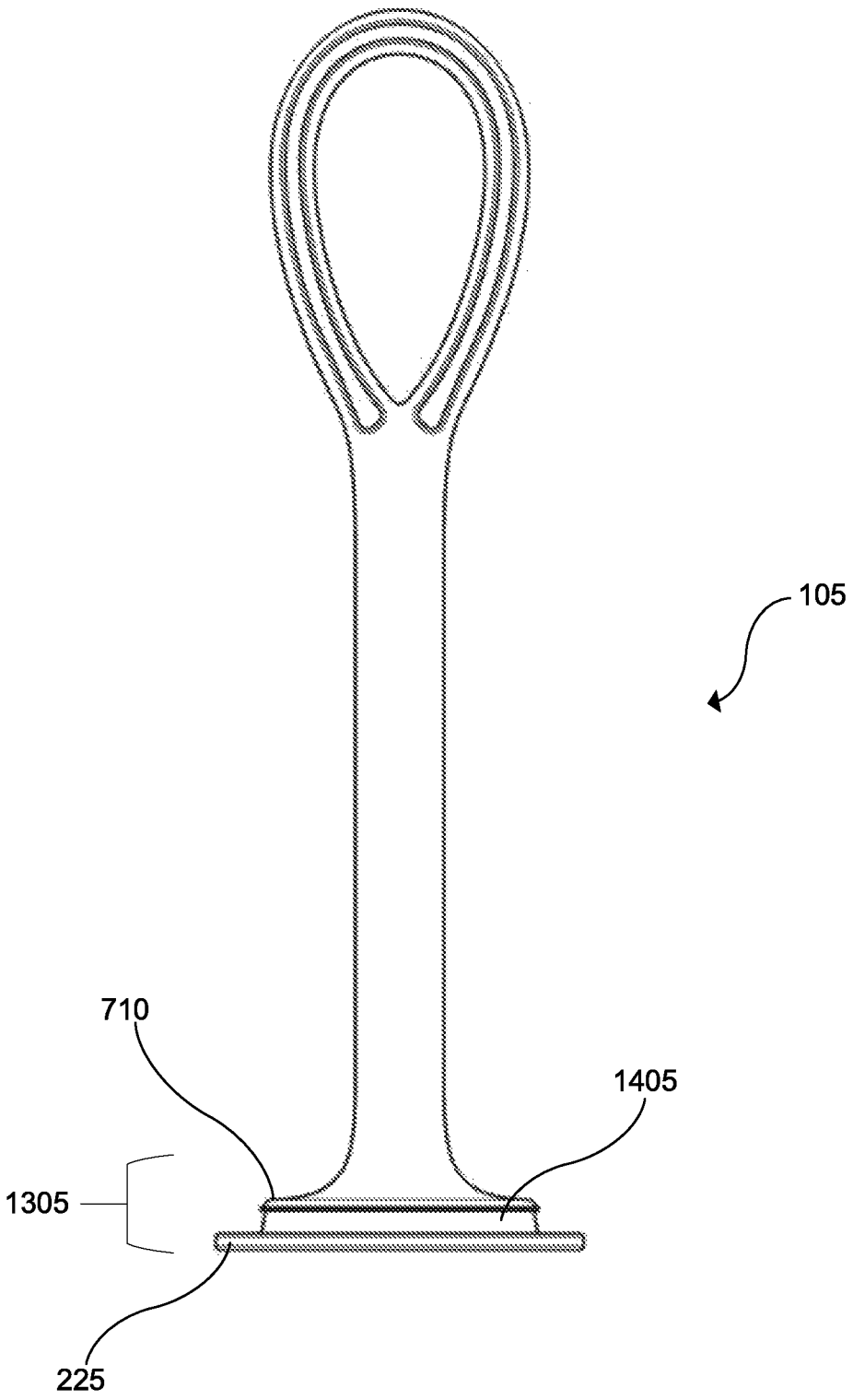
FIG. 14 is a front view of a single handle component, in accordance with some embodiments of the present disclosure.

FIG. 14 is a front view of a single handle 105, according to some embodiments. FIG. 14 depicts a handle connection mechanism 1305 comprising two flanges, in accordance with some embodiments of the present disclosure. In some embodiments, a handle connection mechanism 1305 comprises an upper flange 710, a bottom flange 225, and a connection groove 1405 between the flanges 710, 225. The connection groove 1405 may be configured to accept a basket base 120 or connecting ring 715 (not shown but previously described), i.e., once an upper flange 710 is pulled through the connecting hole of a basket, the perimeter of the connecting hole rests within the connection groove 1405. Designs including a connection groove 1405 must consider the tightness of fit between the basket and the connecting groove 1405. For example and not limitation, a tight fit between the basket and the connection groove 1405 will prohibit the basket from teetering or rotating around the handle 105 at the connection groove 1405 (for circular embodiments); a loose fit may allow the basket to rotate around the handle 105 and may also allow the handle to teeter within the connection groove 1405. It is conceived that the height of the connection groove 1405 may range from about 0.05 mm to about 0.3 mm taller than the basket surface within the groove. For example, the connection groove 1405 may be 3.58 mm tall and the part of the basket within the groove may be 3.40 mm tall, providing a clearance of 0.18 mm.

It is conceived that the width of the connection groove 1405 may range from about 0.10 mm to about 1.00 mm narrower than the connecting hole in the basket. For example, the connection groove may be 46.95 mm wide and the connecting hole may be 47.40 mm wide, providing a clearance of 0.45 mm. Although these dimensions may be beneficial for a system as described herein, the dimensions are merely exemplary, and any other range is conceived, depending on the design features desired for the system.

Figure 15:
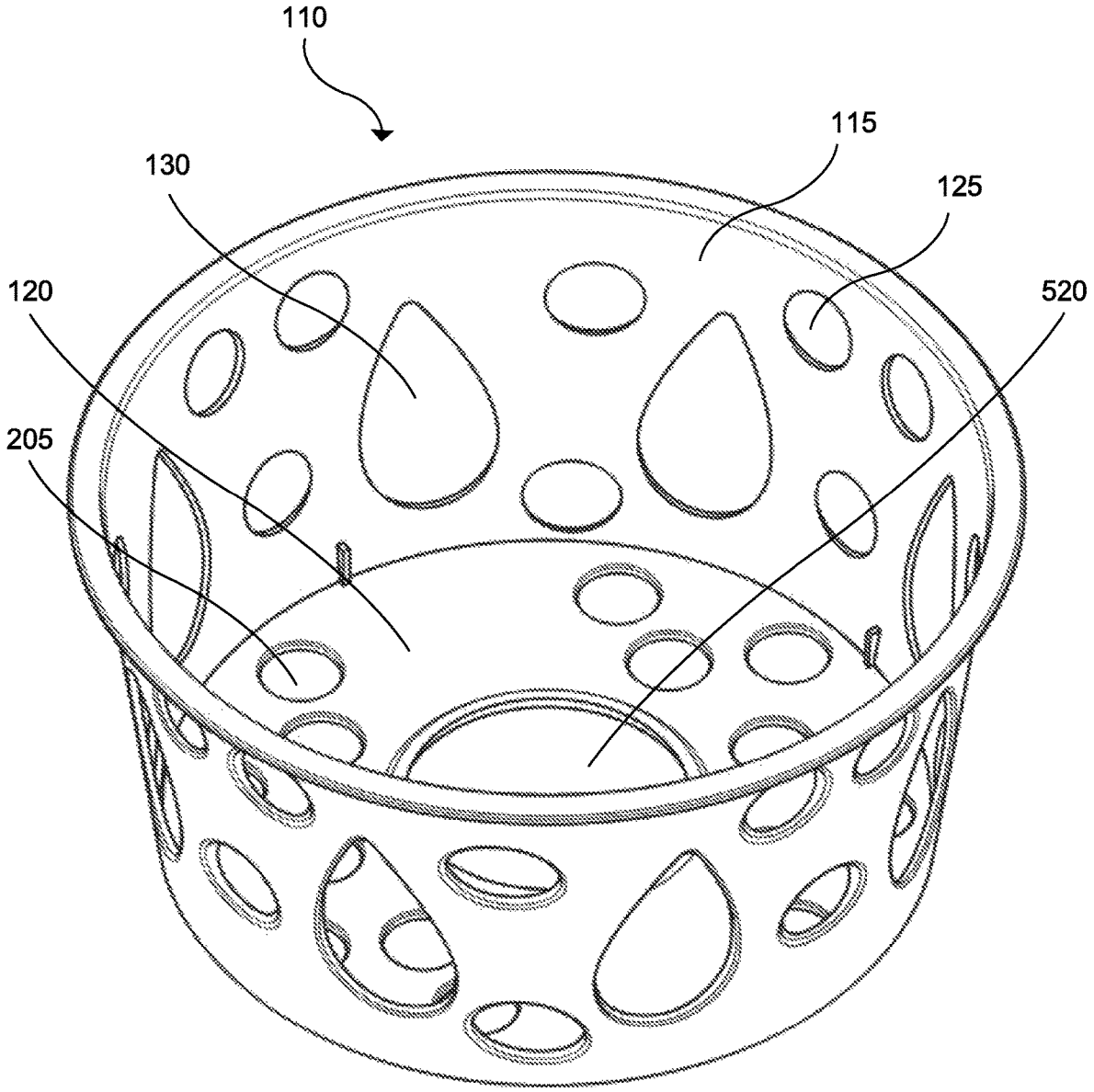
FIG. 15 is a perspective view of a single basket component, in accordance with some embodiments of the present disclosure.

FIG. 15 is a perspective view of a single basket 110, according to some embodiments. The exemplary basket 110 shown in the figure shows many of the features discussed herein, in accordance with the various embodiments described. In some embodiments and as shown, a basket 110 may comprise one or more drain holes 125 within the one or more walls 115 of the basket 110. The drain holes 125 allow water and other fluids to escape the interior of the basket 110. The exemplary embodiment shown in the figure comprises twenty drain holes 125; however, any number of drain holes is conceived. In some embodiments and as shown, a basket 110 may comprise one or more decorative drain holes 130, wherein the decorative drain holes 130 may have a different shape than standard drain holes 125. The exemplary embodiment shown in the figure comprises eight decorative drain holes 130; however, any number of these holes is conceived. A basket 110 may comprise a combination of standard drain holes 125 and decorative drain holes 130; in some embodiments, a basket 110 comprises only one type of drain hole in the walls 115. Additionally, it is not essential that all standard drain holes 125 have the same shape, and it is not essential that all decorative drain holes 130 have the same shape.

In some embodiments and as shown, a basket 110 may comprise one or more bottom drain holes 205 within the base 120 of the basket 110. In some embodiments, the bottom drain holes 205 all have the same shape; however, it is not essential that all bottom drain holes 205 have the same shape. Any number of bottom drain holes 205 are conceived, and the configuration depends on the design considerations discussed herein. In some embodiments and as shown, a basket 110 may comprise a connecting hole 520 within the base of the basket 110. In the embodiment shown, the connecting hole 520 is in the direct center of the basket 110; however, it is conceived that the connecting hole 520 may be positioned at any other locations in the base 120 of the basket 110. Also shown in the figure is one connecting hole 520. It some embodiments, however, multiple connecting holes may be positioned in the base 120 of a basket 110. For example and not limitation, a basket may accept a plurality of handles or a single handle that connects to the basket 110 at a plurality of connecting holes 520.

Figure 16:
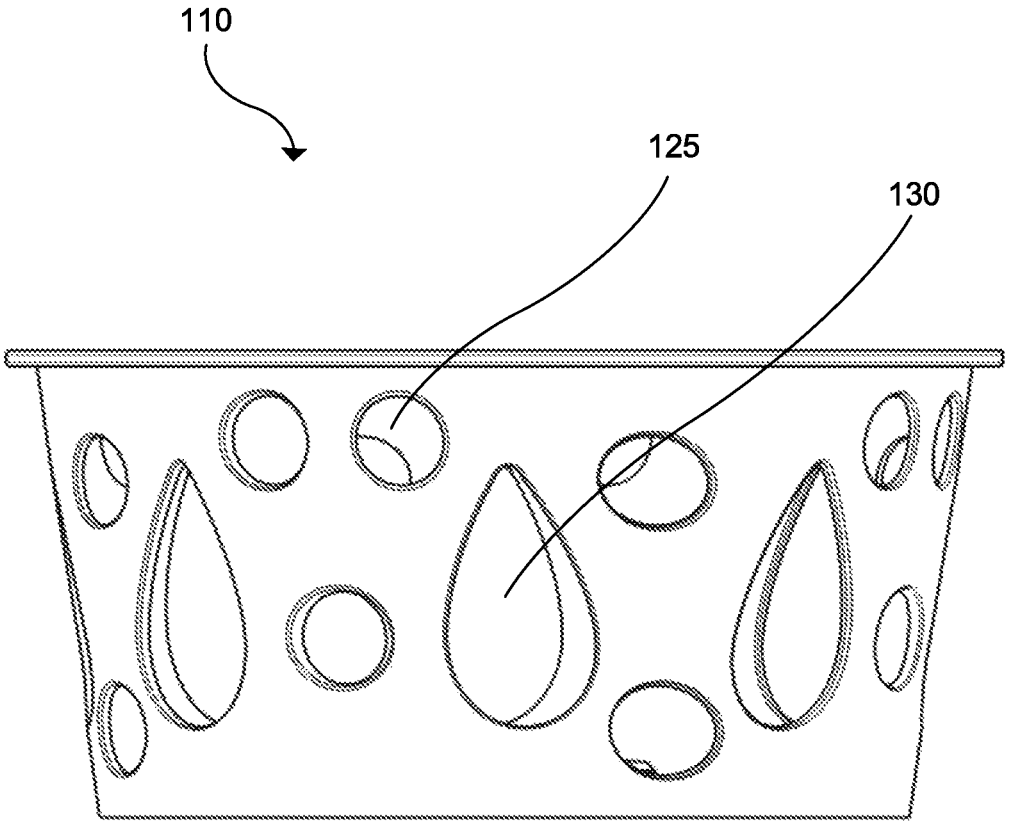
FIG. 16 is a front view of a single basket component, in accordance with some embodiments of the present disclosure.

FIG. 16 is a front view of a single basket 110, according to some embodiments. The exemplary embodiment shown in the figure comprises multiple types of drain holes, e.g., standard drain holes 125 and decorative drain holes 130. In other embodiments of the present disclosure, other drain configures may be present. For example, some embodiments of the present disclosure comprise only one type of drain hole, some embodiments of the present disclosure comprise more than two types of drain holes, and some embodiments of the present disclosure comprise no drain holes.

According to some embodiments, a system is provided for transporting a plurality of baskets. The system can comprise a plurality of nested basket components and a plurality of handle components not attached to the plurality of basket components. Each handle component in the plurality of handle components can correspond to a basket component in the plurality of basket components, such that each handle component can be later attached to a basket component. The basket components in the plurality of nested basket components can be any of the basket components discussed herein. The handle components in the plurality of handle components can be any of the handle components discussed herein. The system can permit the shipment of a plurality of complete baskets, i.e., combination of a handle component and basket component, in a manner that takes up less space than conventional complete baskets.

The invention claimed is:

1. A nestable basket set, comprising:

a basket comprising:

a wall defining a perimeter of the basket;

a base comprising a connection hole;

an upper rim proximate an upper side of the wall, the upper rim defining an upper rim perimeter;

a lower rim proximate a lower side of the wall, the lower rim defining a lower rim perimeter, the upper rim perimeter being greater than the lower rim perimeter; and at least one drain hole in the base; and a handle detachable to the basket, such that when the handle is attached to the basket, the handle extends to a position above the basket proximate an axis of the basket, the handle comprising:

a first end, wherein when the handle is attached to the basket, the first end of the handle extends to the position above the basket proximate the axis of the basket; and a second end comprising:

an upper flange having an upper flange perimeter;

a lower flange having a lower flange perimeter greater than the upper flange perimeter; and a groove positioned between the upper flange and lower flange, wherein when the handle is attached to the basket, the second end is attached to the base and extends through the connection hole such that the lower flange is proximate a lower side of the base, the upper flange is proximate an upper side of the base, and a portion of the base extends into the groove.

2. The nestable basket of claim 1, wherein the upper flange of the handle comprises an angled edge, such that an upper edge of the upper flange has a upper edge perimeter and a lower edge of the upper flange has a lower edge perimeter greater than the upper edge perimeter.

3. The nestable basket of claim 1, wherein the first end of the handle comprises a holding surface.

4. The nestable basket of claim 3, wherein the holding surface defines a loop.

5. The nestable basket of claim 4, further comprising at least one decorative drain hole positioned in the wall, the at least one decorative drain hole having a shape substantially identical to a shape defined by the loop of the handle.

6. The nestable basket of claim 3, wherein the holding surface comprises a groove.

7. The nestable basket of claim 1, wherein the lower rim is non-planar with the base, such that when the basket rests on a planar surface, a gap is present between the base and the planar surface.

8. The nestable basket of claim 7, wherein a width of the gap is greater than or equal to a width of a lower flange of the handle.

9. The nestable basket of claim 1, wherein the base comprises a raised offset, the raised offset creating a gap between the raised offset and a planar surface when the basket rests on the planar surface.

10. The nestable basket of claim 9, wherein a width of the gap is greater than or equal to a width of a lower flange of the handle.

* * * * *